US006563478B2

(12) United States Patent
Aoki

(10) Patent No.: US 6,563,478 B2
(45) Date of Patent: May 13, 2003

(54) DRIVING METHOD FOR ELECTRO-OPTICAL DEVICE, IMAGE PROCESSING CIRCUIT, ELECTRO-OPTICAL DEVICE, AND ELECTRONIC EQUIPMENT

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 112 days.

(21) Appl. No.: 09/726,055

(22) Filed: Nov. 30, 2000

(65) Prior Publication Data

US 2001/0015711 A1 Aug. 23, 2001

(30) Foreign Application Priority Data

Dec. 10, 1999 (JP) ..... 11-351963
Mar. 27, 2000 (JP) ..... 2000-087144
Aug. 31, 2000 (JP) ..... 2000-263564

(51) Int. Cl.[7] ..... G09G 3/20

(52) U.S. Cl. ..... 345/58; 345/30; 345/42; 345/48; 345/51; 345/55

(58) Field of Search ..... 345/30, 42, 46, 345/48, 51, 55, 58, 63, 83, 84, 87, 88, 89–92, 99–104, 212

(56) References Cited

U.S. PATENT DOCUMENTS 5,751,279 A * 5/1998 Okumara ..... 345/204
5,926,158 A * 7/1999 Yoneda et al. ..... 345/90
5,973,657 A * 10/1999 Okada et al. ..... 345/100
6,040,812 A * 3/2000 Lewis ..... 345/691
6,115,018 A * 9/2000 Okumura et al. ..... 345/210
6,144,354 A * 11/2000 Koyama et al. ..... 345/100
6,297,792 B1 * 10/2001 Takahashi ..... 345/208
6,359,608 B1 * 3/2002 Lebrun et al. ..... 345/100

* cited by examiner

*Primary Examiner*—Bipin Shalwala
*Assistant Examiner*—Leonid Shapiro
(74) *Attorney, Agent, or Firm*—Oliff & Berridge, PLC

(57) ABSTRACT

A first sample-and-hold circuit samples and holds an input image signal so as to output an image signal to be applied to a data line causing noise. A correction circuit produces a correcting signal according to the image signal and a pre-charging voltage. An addition circuit adds up an image signal to be applied to a data line affected by the noise and the correcting signal so as to produce a corrected image signal. Consequently, when scanning lines are selected sequentially for each of blocks, into which a plurality of data lines is grouped, in order to display an image, irregular luminance occurring in portions of the displayed image coincident with the borders of the blocks is suppressed to be indiscernible.

23 Claims, 17 Drawing Sheets

DRIVING METHOD FOR ELECTRO-OPTICAL DEVICE, IMAGE PROCESSING CIRCUIT, ELECTRO-OPTICAL DEVICE, AND ELECTRONIC EQUIPMENT

BACKGROUND OF THE INVENTION

1. Field of Invention

The present invention relates to an electro-optical device such as a liquid crystal display device or the like, a driving method for the electro-optical device, an image processing circuit therefore, and electronic equipment using the electro-optical device as a display unit.

2. Description of Related Art

A related electro-optical device, for example, an active matrix liquid crystal display device will be described with reference to FIG. 15 and FIG. 16.

As shown in FIG. 16, a liquid crystal display device consists mainly of a liquid crystal display panel 100, a timing circuit 200, and an image signal processing circuit 300. The timing circuit 200 outputs a timing signal to be employed in respective units. A phase development circuit 301 included in the image signal processing circuit 300 inputs an image signal VID of one channel, develops it into image signals exhibiting N phases (N=6 in FIG. 15) of the image signal VID, and outputs the image signals. The image signal is developed into image signals exhibiting N phases thereof is to extend an application time during which a sampling circuit, to be described later, applies an image signal to each thin-film transistor. Consequently, it is intended to ensure long sampling time and charging/discharging time for a data signal applied to a thin-film transistor (TFT) panel.

An amplification/reversal circuit 302 reverses the polarity of image signals according to a criterion described below, amplifies the signals, and feeds the signals as image signals VID1 to VID6 exhibiting different phases to the liquid crystal display panel 100. The polarity of image signals being reversed means that the voltage levels of the image signals are alternately reversed with the potentials at the half points of the peak pulse amplitudes thereof as reference potentials. Whether or not to reverse the polarity of the image signals is determined according to a criterion described below. Specifically, the criterion is whether an adopted data signal application form defines that the polarity of image signals should be reversed (1) for each scanning line, (2) for each data signal line, or (3) for each pixel location. A cycle of reversal is set to one horizontal scanning period or a dot cycle. This related art will, for convenience, be described on the assumption that the criterion is whether an adopted data signal application form defines that the polarity of image signals should be reversed (1) for each scanning line.

Moreover, a pre-charging signal NRS produced by the timing circuit 200 is a reverse signal, that is, a polarity-reversed signal, and fed to the liquid crystal display panel 100.

Next, the liquid crystal display panel 100 will be described below. The liquid crystal display panel 100 has an element substrate and an opposite substrate opposed to each other while being spaced from each other. The space is filled with a liquid crystal. The element substrate and opposite substrate are formed with quartz substrates or made of a hard glass or the like.

On the element substrate, a plurality of scanning lines 112 is laid down parallel to an X direction in FIG. 16, and a plurality of data lines 114 are arranged in a Y direction orthogonal to the X direction. The data lines 114 are grouped in groups of six into blocks B1 to Bm. Hereinafter, the data lines are generically referred to as the data lines 114 or discretely referred to as the data lines 114*a* to 114*f*.

At the intersections between the scanning lines 112 and data lines 114, gates of thin film transistors (TFTs) 116 serving as switching elements are connected on the scanning lines 112, sources thereof are connected on the data lines 114, and drains thereof are connected to pixel electrodes 118. Each pixel location is composed of the pixel electrode 118, a common electrode formed on the opposite substrate, and the liquid crystal clamped between the electrodes. The pixel locations are arranged in the form of a matrix at the intersections between the scanning lines 112 and data lines 114. A holding capacitor (not shown) is connected to each pixel electrode 118.

A scanning line drive circuit 120 formed on the element substrate places a pulsating scanning line signal sequentially on the scanning lines 112 according to a clock signal CLY output from the timing circuit 200, a reverse clock signal $CLY_{INV}$, and a transfer start pulse DY. Specifically, the scanning line drive circuit 120 shifts the transfer start pulse DY fed initially during a vertical scanning period from one stage therein to another in synchronous with the clock signal CLY or reverse clock signal $CLY_{INV}$, and thus outputs the scanning line signal sequentially to the scanning lines 112. Consequently, the scanning lines 112 are selected sequentially.

A sampling circuit 130 has sampling switches 131 connected to ends of the data lines 114, and thus has the sampling switches 131 associated with the data lines 114. The switches 131 are realized with n-channel TFTs formed on the element substrate. Image signals VID1 to VID6 are applied to the sources of the switches 131. Six switches 131 connected on data lines 114*a* to 114*f* belonging to a block B1 have the gates thereof connected on a signal line on which a sampling signal S1 is placed. Six switches 131 connected on data lines 114*a* to 114*f* belonging to a block B2 have the gates thereof connected on a signal line on which a sampling signal S2 is placed. Likewise, six switches 131 connected on data lines 114*a* to 114*f* belonging to a block Bm have the gates thereof connected on a signal line on which a sampling signal Sm is placed. The sampling signals S1 to Sm are signals used to sample the image signals VID1 to VID6 for each block during a horizontally effective display period.

Moreover, a shift register circuit 140 formed on the element substrate outputs the sampling signals S1 to Sm successively in synchronous with the clock signal CLX output from the timing circuit 200 or the reverse clock signal $CLX_{INV}$ according to the transfer start pulse DX. To be more specific, the shift register circuit 140 shifts the transfer start pulse DX fed initially during a horizontal scanning period from one stage therein to another in synchronous with the clock signal CLX or reverse clock signal $CLX_{INV}$. The shift register circuit 140 narrows the pulse duration of each resultant pulsating signal so that the pulse duration will not be the same between adjoining signals. Consequently, the shift register circuit 140 outputs the sampling signals S1 to Sm successively.

In the foregoing configuration, when the sampling signal S1 is output, the image signals VID1 to VID6 are sampled and applied to the six data lines 114*a* to 114*f* belonging to the block B1. The image signals VID1 to VID6 are written in six pixel locations defined along a currently-selected scanning line by the TFTs 116 associated with the pixel locations.

Thereafter, when the sampling signal S2 is output, the image signals VID1 to VID6 are sampled and applied to the six data lines 114*a* to 114*f* belonging to the block B2. The image signals VID1 to VID6 are written in six pixel locations defined along the currently-selected scanning line by the TFTs 116 associated with the pixel locations.

Likewise, when the sampling signals S3, S4, . . . , Sm are output successively, the image signals VID1 to VID6 are sampled and applied to the six data lines 114*a* to 114*f* belonging to the block B3, B4 . . . , Bm respectively. The image signals VID1 to VID6 are written in six pixel locations defined along the currently-selected scanning line. Thereafter, the next scanning line is selected, and writing is repeated in the same manner as that mentioned above relative to the blocks B1 to Bm.

SUMMARY OF THE INVENTION

According to the foregoing driving method, the number of stages in the shift register circuit 140 for driving and controlling the switches 131 included in the sampling circuit 130 is one-sixth of the number of stages in a shift register required according to a driving method of driving the data lines point-sequentially. Moreover, the frequencies of the clock signal CLX and reverse clock signal $CLX_{INV}$ are also one-sixth of those of signals employed according to the point-sequential driving method. Thus, the number of stages in a shift register is decreased and power consumption. is reduced.

Each data line 114 is accompanied by a parasitic capacitor. The capacitor is formed because each data line 114 is opposed to an opposite electrode with the liquid crystal between them. After a data signal is applied to each data line 114, the TFT 116 is turned on in order to write the voltage on the data line 114 in the pixel location. A voltage is thus applied to the liquid crystal of each pixel location. However, since each data line 114 is accompanied by a parasitic capacitor, even when the data signal is applied to the data line 114, the potential on the data line 114 does not agree with the data signal immediately. The potential on the data line 114 varies depending on a time constant determined with the capacitance of the parasitic capacitor and a resistance exhibited by a line. When a predetermined time has elapsed since the start of application of the data signal, the potential on the data line 114 agrees with the data signal. In this example, the polarity of the data signal is reversed in units of a scanning line. The polarity of the potentials on the data lines 114 must therefore be reversed with the potential at the opposite electrode as a center for each horizontal scanning period. During a certain horizontal scanning period, the polarity of the potentials on the data lines 114 to which the data signal has not been applied are the reverse of the polarity of the data signal to be applied. This leads to a long time required until the potentials on the data lines 114 agree with the data signal.

In efforts to overcome the above drawback, a pre-charge circuit 160 is included. The pre-charge circuit 160 has switches 165 connected to the other ends of the data lines 114, and thus associated with the data lines 114. The switches 165 are realized with TFTs formed on the element substrate. The drains of the TFTs (or sources thereof) are connected on the data lines 114, and the sources (or drains) thereof are connected to a signal line on which a pre-charging signal NRS is placed. The gates of the switches 165 are connected on a signal line on which a pre-charge driving signal NRG is placed. The pre-charge driving signal NRG is a pulsating. signal that is driven high during a horizontal retrace line period from the instant selection of a certain scanning line is terminated to the instant a succeeding scanning line is selected and the image signals are applied to the data lines. The data lines 114 are pre-charged to the level of the pre-charging signal NRS through the switches 165. The potentials on the data lines 114 are then changed to the levels of the image signals VID1 to VID6 sampled through the switches 131. Consequently, the magnitudes of charge or discharge by which the data lines 114 are charged or discharged with the image signals VID1 to VID6 are so limited that the time required for writing is shortened.

However, when a method of driving a plurality of data lines simultaneously is adopted or when pre-charging is added as one step to the method of driving a plurality of data lines simultaneously, irregular luminance occurs in portions of a displayed image coincident with the borders among the blocks B1 to Bm. The irregular luminance occurs, especially, in a halftone regular pattern. The principles of the irregular luminance will be described in relation to the blocks B1 and B2 by taking for instance a case where a simple and uniform pattern is displayed. The image signal VID6 to be applied to the data line 114*f* belonging to the block B1 and adjoining the block B2 has, as shown in FIG. 17, the same voltage level as the image signal VID1 to be applied to the data line 114*a* belonging to the block B2 and adjoining the block B1. In general, the image signals VID1 to VID6 are set to voltage levels associated with a black level of a gray scale during a horizontal retrace line period.

FIG. 17 shows waveforms attained in a case where the polarity of the precharging signal NRS is the same as the polarity of the image signals VID1 to VID6 (FIG. 16 shows the signals VID1 and VID6 alone) applied to the data lines 114, and reversed in units of a scanning line. Hereinafter, an absolute value of a difference between a mean of the potentials on the data lines 114 to which the image signals VID have been applied and the potential on the data lines 114 to which the pre-charging signal NRS has been applied shall be referred to as a pre-charging voltage Vpre.

Referring to the waveforms shown in FIG. 17, the pre-charging voltage Vpre is set to a level associated with a black level of a gray scale in a normally-white mode (or a white level in a normally-black mode). This is because the data lines are temporarily pre-charged until the voltage on the data lines changes greatly.

Referring to FIG. 17, the pre-charge driving signal NRG is driven high at a timing t11 within a time interval within which the image signals applied are of positive polarity. All of the switches 165 are therefore turned on. All of the data lines 114 are pre-charged to the level of the pre-charging voltage Vpre through the switches 165. Thereafter, the pre-charge driving signal NRG is driven low. All of the data lines hold the pre-charging voltage Vpre because of their parasitic capacitors.

At a timing t12, the sampling signal S1 is driven high. The image signal VID6 is sampled and applied to the data line 114*f* belonging to the block B1 through the switch 131. The voltage on the data line 114*f* changes from the level of the pre-charging voltage Vpre of the pre-charging signal NRG, which has been held on the data line, to the voltage level of the image signal VID6. The voltage is then written in the pixel location defined along a currently-selected scanning line by the associated TFT 116. Thereafter, the sampling signal S1 is driven low.

At a timing t13, the sampling signal S2 is driven high. The image signal VID1 is sampled and applied to the data line 114*a* belonging to the block B2 through the switch 131. The voltage on the data line 114*a* belonging to the block B2 therefore changes from the level of the pre-charging voltage Vpre, which has been held on the data line, to the voltage level of the sampled image signal VID1. The voltage is then written in the pixel location defined along a currently-selected scanning line by the associated TFT 116.

In contrast, the data line 114*f* belonging to the block B1 and adjoining the block B2 is capacitively coupled to the data line 114*a* belonging to the block B2 with the liquid crystal layer between them. When the potential on the data line 114*a* of the block B2 changes from the level of the pre-charging voltage Vpre to the voltage level of the image signal VID1, the voltage on the data line 114*f* fluctuates while being affected by the voltage change, though writing the voltage on the data line 114*f* in the pixel location has already been completed.

An optical density in the pixel location defined along the data line 114*f* of the block B1 and a currently-selected scanning line is changed from a value proportional to a primary writing voltage (1) to a value proportional to a voltage (2) deviated by a voltage proportional to the fluctuation caused by the capacitive coupling. The same applies to timings t21, t22, and t23 within a time interval within which the data signals applied are of negative potential, to the other blocks B2 to Bm−1 relative to the currently-selected scanning line, and to the other scanning lines selected.

However, the other data lines 114*a* to 114*e* belonging to each block are never (hardly) affected by a voltage change on the data line 114*a* belonging to an adjoining block. An optical density in a pixel location defined along each of these data lines and a currently-selected scanning line is retained at a value proportional to a primary writing voltage.

Thus, an optical density in a pixel location defined along the data line 114*f* belonging to a certain block is different from optical densities in pixel locations defined along the other data lines 114*a* to 114*e*. Therefore, even when an attempt is made to display an image with the pixel locations associated with pixels constituting the image held at the same optical density, irregular luminance occurs in portions of a displayed image coincident with the borders among the blocks B1 to Bm.

The irregular luminance can be overcome to some extent. Specifically, the pre-charging signal NRS is set to a voltage level whose absolute value varies depending on whether the pre-charging signal NRS is of positive or negative polarity. For example, when the pre-charging signal NRS assumes positive polarity, it is set to a voltage level whose absolute value is associated with a white level of a gray scale. When the pre-charging signal NRS assumes negative polarity, it is set to a voltage level whose absolute value is associated with a black level thereof. When an image signal of positive polarity is sampled, a voltage whose level is associated with the black level is written. When an image signal of negative polarity is sampled, a voltage whose level is associated with the white level is written. Consequently, the pre-charging signal NRS and writing voltage are canceled out. Therefore, the irregular luminance can be overcome to some extent. However, even when this method is adopted, it is impossible to overcome the irregular luminance to such an extent that the irregular luminance is indiscernible. Moreover, a direct voltage is applied to each pixel location during a short period from application of the pre-charging signal NRS to writing of primary data. This may cause deterioration of a liquid crystal.

The present invention attempts to at least break through the foregoing situation. An object of the present invention is to at least provide a driving method for an electro-optical device capable of making irregular luminance, which occurs in portions of a displayed image coincident with borders among blocks, indiscernible, and displaying the image with high quality, an image processing circuit, an electro-optical device, and electronic equipment.

According to an exemplary embodiment of the present invention, there is provided a driving method for an electro-optical device that has a plurality of scanning lines, a plurality of data lines, transistors located at the intersections between the scanning lines and data lines, and pixel electrodes connected to the transistors. Herein, the scanning lines are selected sequentially. During a period during which each scanning line is selected, image signals are applied simultaneously-to data lines belonging to each of blocks into which the data lines are grouped. This application is carried out sequentially for each block. The image signal to be applied to a first data line belonging to a selected block and adjoining a succeeding block is corrected in advance based on a predicted change in the potential on a second data line belonging to the succeeding block and adjoining the first data line. The corrected image signal is applied to the first data line.

In general, the plurality of data lines is capacitively coupled to one another with pixel locations among them. As far as the data lines belonging to the same block are concerned, sampling is carried out at the same timing. A change in the voltage on a certain data line will not affect the voltages on the other data lines. However, when it comes to data lines belonging to different blocks, a change in the voltage on one of the data lines will affect the voltage on the other data line. Specifically, the voltage on a data line located on one edge of a block fluctuates from its primary writing voltage when the voltage on a data line located on the other edge of an adjoining block changes to the voltage level of a sampled image signal. This causes irregular luminance to occur in portions of a displayed image coincident with borders among blocks.

In the driving method according to another exemplary embodiment of the present invention, a change in the voltage on the second data line belonging to a succeeding block is predicted. The image signal to be applied to the first data line is corrected in advance based on the predicted voltage change, and then applied to the first data line. Even if noise stemming from the voltage change on the second data line enters the first data line because of a coupling capacitor, the noise is canceled by the corrected image signal. Consequently, irregular luminance occurring in portions of a displayed image coincident with the borders among the blocks can be minimized successfully.

Incidentally, the voltage change on the second data line depends on the level of an applied image signal. Therefore, the voltage change on the second data line is preferably predicted based on the image signal. to be applied to the second data line.

In the driving method according to another exemplary embodiment of the present invention, preferably, an electro-optical device has sampling transistors for sequentially sampling image signals and applying the image signals to the data lines. The voltage change on the second data line is preferably predicted based on the image signal to be applied to the second data line and a voltage drop occurring at an associated sampling transistor. When the sampling transistors are realized with TFTs or any other field-effect transistors, the voltage drop varies depending on a source voltage of each sampling transistor. According to the various exemplary embodiments of the present invention, the voltage change on the second data line may be predicted in consideration of the voltage drop. Irregular luminance occurring in portions of a displayed image coincident with the borders among the blocks can be minimized more successfully.

According to another exemplary embodiment of the present invention, a driving method for an electro-optical device is to be adapted to an electro-optical device that has a plurality of scanning lines, a plurality of data lines, and transistors and pixel electrodes located at the intersections between the scanning lines and data lines. The scanning lines are selected sequentially. During a period during which each scanning line is selected, a pre-charging voltage is applied to blocks into which the data lines are grouped. Thereafter, an image signal to be applied to a first data line belonging to a selected block and adjoining a succeeding block is corrected in advance based on a predicted change in the voltage on a second data line belonging to the succeeding block and adjoining the first data line. The corrected image signal is then applied to the first data line. The voltage change on the second data line is preferably predicted based on the image signal to be applied to the second data line and the pre-charging voltage.

According to another exemplary embodiment of the present invention, the data lines are pre-charged before image signals are applied to the data lines. Once the pre-charging signal is set to a proper level, the time required for application of the image signals can be minimized. Moreover, the voltage change on the second data line is derived from a change from in the pre-charging signal to an image signal. Therefore, the voltage change on the second data line can be predicted accurately based on the image signal to be applied to the second data line and the pre-charging signal.

An electro-optical device may have the sampling transistors for sequentially sampling the image signals and applying them to the data lines. In this case, the voltage change on the second data line is preferably predicted based on the image signal to be applied to the second data line, a voltage drop occurring at an associated sampling transistor, and the pre-charging signal. According to the various exemplary embodiments of the present invention, the voltage change on the second data line may be predicted in consideration of the voltage drop. Irregular luminance occurring in portions of a displayed image coincident with the borders of the blocks can be minimized more successfully.

According to another exemplary embodiment of the present invention, an image processing circuit is to be adapted to an electro-optical device having a plurality of scanning lines, a plurality of data lines, and transistors and pixel electrodes located at the intersections between the scanning lines and data lines. The scanning lines are selected sequentially. During a period during which each scanning line is selected, after a pre-charging voltage is applied to the data lines, parallel-form image signals are applied to each of blocks into which the data lines are grouped. The image processing circuit includes a parallel circuit, a correction circuit, and an output circuit. The parallel circuit expands an input image signal in terms of a time base, converts it from a serial form to a parallel form according to the number of data lines constituting each block, and thus produces a plurality of parallel-form image signals. The correction circuit corrects a parallel-form image signal, which is to be applied to a first data line belonging to a certain block and adjoining a succeeding block, according to a predicted change in the voltage on a second data line belonging to the succeeding block and adjoining the first data line. The output circuit outputs the corrected parallel-form image signal together with the other parallel-form image signals.

According to another exemplary embodiment of the present invention, an input image signal is expanded in terms of a time base, and converted from a serial form to a parallel form. A plurality of parallel-form image signals is thus produced. A parallel-form image signal to be applied to a first data line belonging to a certain block and adjoining a succeeding block is specified from among the plurality of parallel-form image signals. A change in the voltage on a second data line belonging to the succeeding block is predicted. The image signal to be applied to the first data line is corrected in advance based on the predicted potential change, and applied to the first data line. Even if noise stemming from the voltage change on the second data line enters the first data line through a coupling capacitor, the noise is canceled by the corrected image signal. Consequently, irregular luminance occurring in portions of a displayed image coincident with the borders among the blocks can be minimized successfully.

According to another exemplary embodiment of the present invention, in the electro-optical device, during the period during which each scanning line is selected, after a predetermined pre-charging voltage is applied to the data lines, the parallel-form image signals may be applied to each of the blocks into which the data lines are grouped. In this case, the correction circuit preferably predicts the voltage change on the second data line according to the parallel-form image signal to be applied to the second data line and the pre-charging voltage. The voltage change can thus be predicted accurately. The correction can be achieved precisely. Consequently, irregular luminance occurring in portions of a displayed image coincident with the borders among the blocks can be minimized more successfully.

According to another exemplary embodiment of the present invention, the electro-optical device may have the scanning lines, data lines, transistors, and pixel electrodes formed on one substrate, and have opposite electrodes formed on the other substrate opposed to the substrate. During the period during which each scanning line is selected, after the pre-determined pre-charging voltage is applied to the data lines, the parallel-form image signals may be applied to each of the blocks, into which the data lines are grouped, via sampling transistors. In this case, the output circuit preferably combines the corrected parallel-form image signal with the other parallel-form image signals, reverses the polarity of the image signals with the potential at the opposite electrodes as a reference according to a polarity reversing signal of a certain cycle, and outputs the resultant image signals. Moreover, the correction circuit preferably predicts the voltage change on the second data line according to the parallel-form image signal to be applied to the second data line, the pre-charging voltage, and a voltage drop occurring at an associated sampling transistor.

When a liquid crystal is adopted as an electro-optical material, an alternating voltage must be applied to the liquid crystal in order to prevent deterioration of the liquid crystal. In this case, the output circuit reverses the polarity of the parallel-form image signals with the potential at the opposite electrodes as a reference according to the polarity reversing signal, and then outputs the resultant image signals. Although each image signal exhibits the one and only voltage level associated with a certain gray-scale level irrespective of its polarity, the voltage drop at an associated sampling transistor is different between the polarities of the image signal. According to the various exemplary embodiments of the present invention, the potential change on the second data line is predicted accurately based on the parallel-form image signal, pre-charging voltage, and voltage drop. Irregular luminance occurring in portions of a displayed image coincident with the borders among the blocks can be minimized more successfully.

In the electro-optical device, during the period during which each scanning line is selected, after the predetermined pre-charging voltage is applied to the data lines, the parallel-form image signals may be applied to each of the blocks into which the data lines are grouped. Moreover, the input image signal may be an analog signal. In this case, the correction circuit preferably includes a sample-and-hold circuit, a correcting signal production circuit, and a synthesizer circuit. The sample-and-hold circuit samples and holds the input image signal for each block, and outputs a parallel-form image signal to be applied to the second data line. The correcting signal production circuit produces a correcting signal according to the parallel-form image signal output from the sample-and-hold circuit and the pre-charging voltage. The synthesizer circuit synthesizes a parallel-form image signal, which is output from the parallel circuit and is to be corrected, with the correcting signal, and outputs a corrected parallel-form image signal.

In this case, the sample-and-hold circuit specifies a parallel-form image signal to be applied to the second data line, that is, a signal to be applied to a data line that causes noise. The correcting signal production circuit produces a correcting signal according to the parallel-form image signal and pre-charging voltage. The noise entering the first data line stems from a change in the voltage on the second data line. The voltage change on the second data line is derived from a change from the pre-charging voltage to the parallel-form image signal. The correcting signal therefore reflects an accurately predicted change in the voltage on the second data line. Even if noise stemming from the voltage change on the second data line enters the first data line via a coupling capacitor, the noise is canceled by the corrected parallel-form image signal. Consequently, irregular luminance occurring in portions of a displayed image coincident with the borders among the blocks can be minimized successfully.

According to another exemplary embodiment of the present invention, the input image signal may be an analog signal. In this case, the correction circuit preferably includes a sample-and-hold circuit, a first calculation circuit, a second calculation circuit, a correcting signal production circuit, and a synthesizer circuit. The sample-and-hold circuit samples and holds the input image signal for each block, and outputs a parallel-form image signal to be applied to the second data line. The first calculation circuit calculates the voltage drop according to the parallel-form image signal output from the sample-and-hold circuit and the polarity reversing signal. The second calculation circuit calculates a writing voltage to be applied to the second data line according to the voltage drop calculated by the first calculation circuit and the parallel-form image signal output from the sample-and-hold circuit. The correcting signal production circuit produces a correcting signal according to the writing voltage and pre-charging voltage. The synthesizer circuit synthesizes the parallel-form image signal, which is output from the parallel circuit and is to be corrected, with the correcting signal, and outputs a corrected parallel-form image signal.

According to another exemplary embodiment of the present invention, the correcting signal can be produced in consideration of the voltage drop occurring at an associated sampling transistor. Irregular luminance occurring in portions of a displayed image coincident with the borders among the blocks can be minimized more successfully.

An image processing circuit in accordance with another exemplary embodiment of the present invention is to be adapted to an electro-optical device having a plurality of scanning lines, a plurality of data lines, and transistors and pixel electrodes located at the intersections between the scanning lines and data lines. The scanning lines are selected sequentially. During a period during which each scanning line is selected, parallel-form image signals are applied to each of blocks into which the data lines are grouped. The image processing circuit includes a correction circuit and a parallel processor. The correction circuit specifies an image signal, which is to be applied to a first data line belonging to a certain block and adjoining a succeeding block, by sampling an input image signal. The correction circuit then corrects the image signal according to a predicted change in the voltage on a second data line belonging to the succeeding block and adjoining the first data line. The parallel processor expands an output signal of the correction circuit in terms of a time base, converts it from a serial form to a parallel form according to the number of data lines constituting each block, and thus produces a plurality of parallel-form image signals.

According to another exemplary embodiment of the present invention, an image signal to be applied to the first data line belonging to a certain block and adjoining a succeeding block is specified by sampling the input image signal. A change in the voltage on the second data line belonging to the succeeding block is predicted. The image signal to be applied to the first data line is corrected in advance based on the predicted voltage change, and then applied to the first data line. Even if noise stemming from the potential change on the second data line enters the first data line via a coupling capacitor, the noise is canceled by the corrected image signal. Consequently, irregular luminance occurring in portions of a display image coincident with the borders among the blocks can be minimized successfully.

According to another exemplary embodiment of the present invention, the input image signal may be a digital signal. In this case, the correction circuit preferably includes a selection circuit, a memory circuit, and a synthesizer circuit. The selection circuit selects the input image signal for each block during one specified sampling period. In the memory circuit, signal voltage levels are stored in association with correction voltage levels. A correcting signal whose voltage level is associated with that of an output signal of the selection circuit is output from the memory circuit. The synthesizer circuit synthesizes the input image signal with the correcting signal.

In the electro-optical device, during the period during which each scanning line is selected, after the predetermined pre-charging voltage is applied to the data lines, the parallel-form image signals may be applied to each of blocks into which the data lines are grouped. In this case, the correction voltage levels are preferably determined based on the pre-charging voltage and the signal voltage levels. Consequently, the potential change on the second data line is predicted based on the pre-charging voltage and signal voltage level, and therefore predicted accurately.

Preferably, the memory circuit has a correction table listing voltage levels to be applied to the second data line and represented by image data. Consequently, irregular luminance occurring in portions of a displayed image coincident with the borders among the blocks can be minimized successfully.

The image processing circuit in accordance with another exemplary embodiment of the present invention is to be adapted to an electro-optical device having the scanning lines, data lines, transistors, and pixel electrodes formed on one substrate, and having opposite electrodes formed on the other substrate opposed to the substrate. During a period during which each scanning line is selected, after the predetermined pre-charging voltage is applied to the data lines, the parallel-form image signals are applied to each of the blocks, into which the data lines are grouped, via sampling transistors. The image processing circuit includes a polarity reversal circuit for reversing the polarity of the plurality of parallel-form image signals output from the parallel processor with the potential at the opposite electrodes as a reference according to a polarity reversing signal of a certain cycle. The input image signal is a digital signal representing input image data. The correction circuit includes a selection circuit, a first memory circuit, a second memory circuit, a reader circuit, and a synthesizer circuit. The selection circuit selects the input image data for each block during one specified sampling period. Voltage levels to be represented by image data are stored in association with voltage levels to be represented by correction data, which is used to correct an input image signal of positive polarity, in the first memory circuit. Voltage levels to be represented by image data are stored in association with voltage levels to be represented by correction data, which is used to correct an input image signal of negative polarity, in the second memory circuit. The reader circuit places output data of the selection circuit in the first memory circuit or second memory circuit according to the polarity reversing signal, and reads associated correction data. The synthesizer circuit synthesizes the input image data with the correction data read by the reader means.

According to another exemplary embodiment of the present invention, the correction data for an input image signal of positive polarity and the correction data for an input image signal of negative polarity are stored in the first memory circuit and second memory circuit respectively. Correction data can therefore be produced according to a polarity represented by the polarity reversing signal. Namely, a correcting signal can be produced in consideration of the voltage drop occurring at an associated sampling transistor. Irregular luminance occurring in portions of a display image coincident with the borders among the blocks can be minimized more successfully.

The input image signal may be a digital signal. Accordingly, the parallel processor may include a D/A converter and a parallel circuit. The D/A converter converts the digital output signal of the correction circuit into an analog form. The parallel circuit expands the analog signal output from the D/A converter in terms of a time base, converts it from a serial form to a parallel form according to the number of data lines constituting each block, and thus produces a plurality of analog parallel-form image signals. In this case, the D/A converter may handle a signal of one channel. The analog signal is converted from the serial form to the parallel form.

The input image signal may be a digital signal. Accordingly, the parallel processor may include a parallel circuit and a D/A converter. The parallel circuit expands a digital output signal of the correcting circuit in terms of a time base, converts it from a serial form to a parallel form according to the number of data lines constituting each block, and thus produces a plurality of digital parallel-form image signals. The D/A converter converts the plurality of digital parallel-form image signals produced by the parallel circuit into an analog form, and outputs a plurality of analog parallel-form image signals. In this case, the digital signal is converted from the serial form to the parallel form. Consequently, digital parallel-form image signals exhibiting the same characteristics can be produced.

An electro-optical device in accordance with another exemplary embodiment of the present invention consists mainly of the foregoing image processing circuit, a scanning line drive circuit, a block drive circuit, and a pre-charge circuit. The scanning line drive circuit selects the scanning lines sequentially. The block drive circuit sequentially selects blocks, into which the data lines are grouped, during a period during which each scanning line is selected, and applies parallel-form image signals to the data lines belonging to a selected block. Before a block is selected, the pre-charge circuit applies a pre-charging voltage to the data lines belonging to the block. Preferably, the pre-charge circuit sets the pre-charging voltage to a voltage level associated with a substantially black level of a gray scale or a substantially white level thereof. Consequently, the pre-charging voltage whose level is associated with the substantially black level is applied to the data lines in a normally-white mode, while the pre-charging voltage whose level is associated with the substantially white level is applied thereto in a normally-black mode. This results in distinct contrast.

Electronic equipment in accordance with another exemplary embodiment of the present invention is characterized in that an electro-optical device is adopted as a display unit. The electronic equipment is, for example, a video projector, a note-shaped personal computer, or a portable telephone.

DETAILED DESCRIPTION OF PREFERRED EMBODIMENTS

Exemplary embodiments of the present invention will be described with reference to the drawings below.

(First Exemplary Embodiment)

<Configuration>

To begin with, an active matrix liquid crystal display device in accordance with the first exemplary embodiment will be described as an example of an electro-optical device. According to the present embodiment, an input image signal to be fed to the liquid crystal display device shall be an analog signal.

Figure 1:
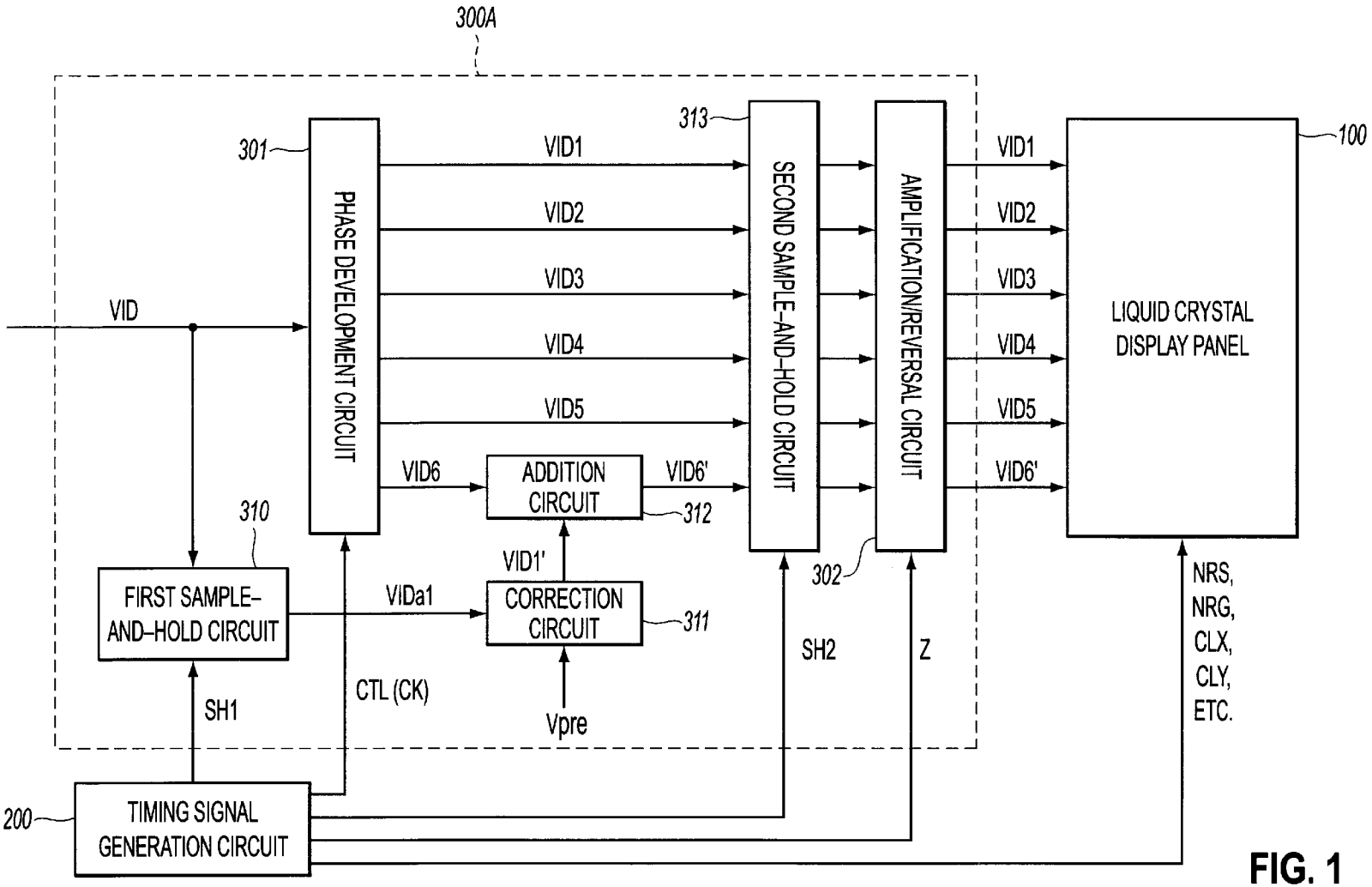
FIG. 1 is a block diagram showing the overall configuration of a liquid crystal display device in accordance with a first exemplary embodiment of the present invention.

FIG. 1 is a block diagram showing the overall configuration of the liquid crystal display device. The liquid crystal display device in accordance with the present embodiment is different from the one shown in FIG. 15 in a point that a first sample-and-hold circuit 310, a correction circuit 311, an addition circuit 312, and a second sample-and-hold circuit 313 are included in an image processing circuit 300A in efforts to overcome the irregular luminance.

The first sample-and-hold circuit 310 samples and holds an input image signal VID during a period during which a sample-and-hold signal SH1 remains high, and produces an image signal VIDa1. The sample-and-hold signal SH1 is produced for each block, and goes high during one sampling period immediately after handling a block is started.

Figure 15:
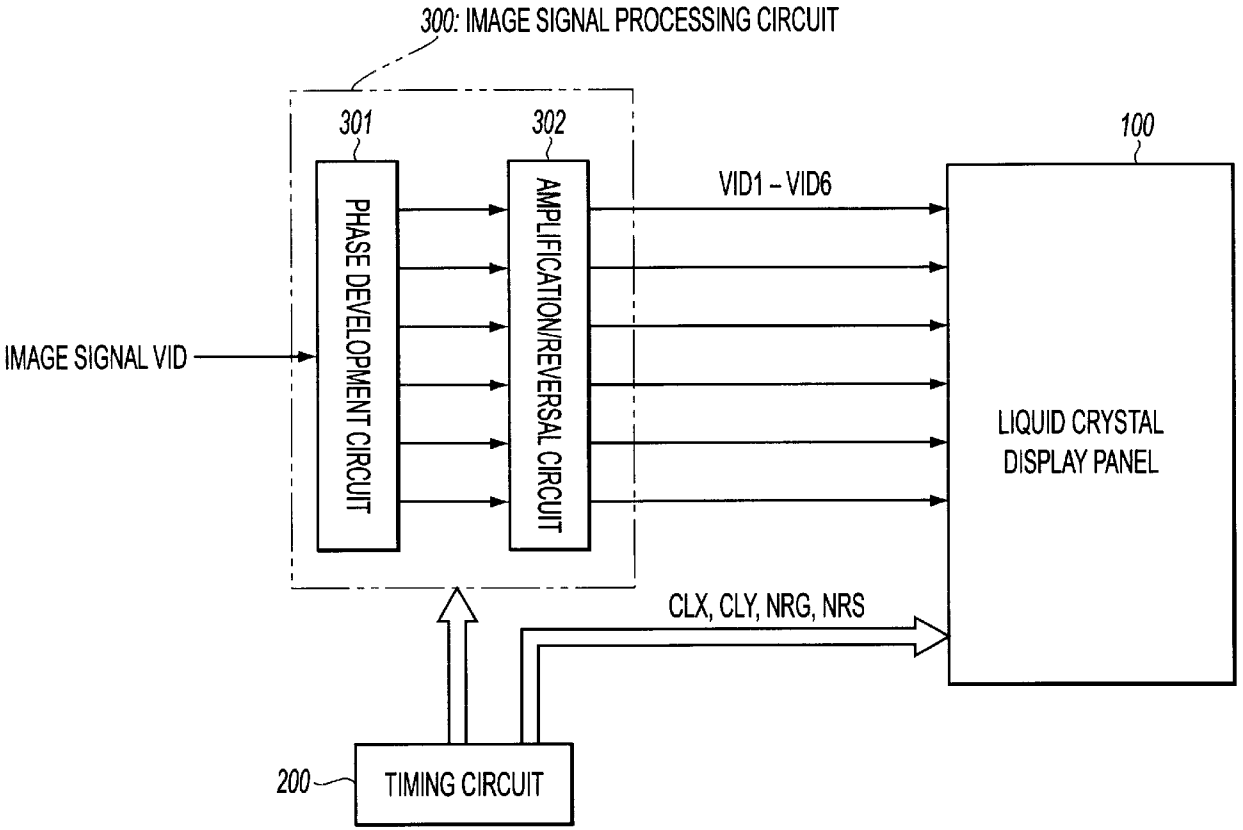
FIG. 15 RELATED ART
FIG. 15 is a block diagram showing the overall configuration of a related liquid crystal display device.

As described previously in relation to the liquid crystal display device of FIG. 15, irregular luminance occurring in portions of a display image coincident with the borders among the blocks is attributable to capacitive coupling of adjoining data lines 114 with a liquid crystal layer between them. Assuming that blocks B1 to Bm are selected sequentially from right to left, data lines affected by adjoining ones are the data lines 114*f* located on the right edges of the blocks B2 to Bm. Data lines affecting adjoining ones are the data lines 114*a* located on the left edges of blocks adjoining and succeeding the blocks B2 to Bm. The sample-and-hold signal SH1 is driven high by a timing signal generation circuit 200 synchronously with the timing of an image signal VID1 to be supplied to the data lines 114*a* of the blocks that affect adjoining data lines. An output signal of the first sample-and-hold circuit 310 is therefore the image signal VIDa1 to be supplied to the data lines 114*a* located on the left edges of the blocks.

The correction circuit 311 produces a correcting signal VID1', which is comparable to noise, according to the image signal VIDa1. The correction circuit 311 is composed of, for example, a subtraction circuit for producing a difference voltage between the image signal VIDa1 and a pre-charging voltage Vpre, and a low-pass filter for producing a correcting signal VID1' using the difference voltage.

Assume that adjoining data lines are capacitively coupled to each other with a liquid crystal layer between them. In this case, noise enters from the data line 114*a* (second data line located on the left edge of a current block) driven to exhibit a low impedance to the data line 114*f* (first data line located on the right edge of a preceding block) exhibiting a high impedance. The noise is determined with a change in the potential on the data line 114*a* exhibiting a low impedance. If a difference voltage Band a transmission characteristic are available, the noise can be calculated.

How the difference voltage is transmitted to an adjoining data line is determined based on the capacitance of a parasitic capacitor accompanying the data line, the capacitance of a coupling capacitor coupling data lines, and an output impedance presented by a data line drive circuit. In an actual liquid crystal display device, various factors relate to one another in a complex manner. The type and transmission characteristic of a low-pass filter are therefore determined. experimentally. The correction circuit 311 predicts a change in the voltage on the data line 114*a* which causes noise, and predefines a transmission characteristic according to which a signal component enters from the data line 114*a* to the data line 114*f* is determined. The correction circuit 311 then produces the correcting signal VID1', which cancels out noise, according to the predicted voltage change and the predefined transmission characteristic.

An addition circuit 312 is interposed between the phase development circuit 301 and a second sample-and-hold circuit 313, and designed to add up an image signal VID6 and the correcting signal VID1'. An image signal VID6' output from the addition circuit 312 is expressed as VID6'= VID6+VID1'.

The second sample-and-hold circuit 313 is intended to output the image signals VID1 to VID5 simultaneously with the image signal VID6'. The image signals VID1 to VID5 and image signal VID6' are sampled and held in response to a sample-and-hold signal SH2.

The image signal VID6 is a signal to be supplied to the data line 114*f* located on the right edge of each block. The image signal VID6 to be supplied to the data line 114*f* affected by noise can be corrected in advance. The image signals VID1 to VIDS and the thus produced image signal VID6' are amplified to predetermined voltage levels by the amplification/reversal circuit 302, and have the polarity thereof reversed synchronously with a pre-charging voltage Vpre according to a polarity reversing signal Z.

Consequently, even when the image signal VID6' is supplied to the data line 114*f* and noise comparable to the signal VID1' is placed on the data line 114*f*, the noise comparable to the signal VID1' is canceled by the image signal VID6'. Eventually, the image signal VID6 that should primarily be written is written.

The other components are identical to those of the liquid crystal display device of FIG. 15. The iteration of the components will not be needed.

Figure 2:
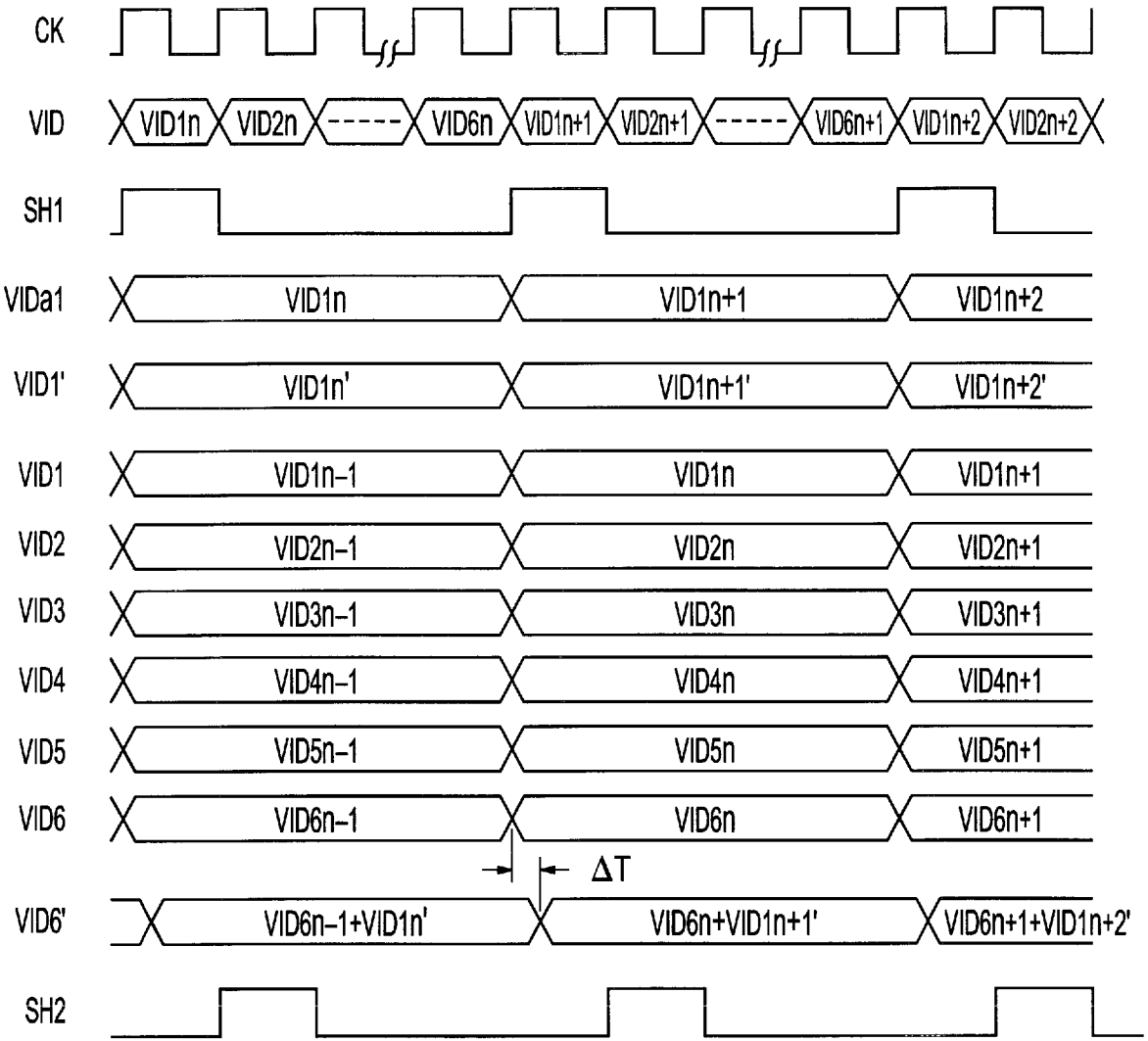
FIG. 2 is a timing chart indicating actions performed in an image display circuit incorporated in the liquid crystal display device of FIG. 1.

Next, exemplary embodiments to be performed in the liquid crystal display device will be described. FIG. 2 is a timing chart for describing actions to be performed in the image processing circuit 300A. In FIG. 2, a letter X included in VIDXY specifies a data line of a block preceded by X−1 data lines when the data lines constituting the block are counted in a direction of scanning. A letter Y included therein specifies a block preceded by Y−1 blocks. For example, 1n+1 of VID1n+1 specifies the first data line of the n+1-th block.

First of all, the timing signal generation circuit 200 produces a clock pulse CK according to the samples of the input image signal VID. The timing signal generation circuit 200 produces the sample-and-hold signal SH1 that is synchronous with the clock pulse CK and that specifies an image signal VID1 to be supplied to the first data line 114*a* of each block.

The sample-and-hold signal SH1 is fed to the first sample-and-hold circuit 310. The first sample-and-hold circuit 310 samples the input image signal VID to hold the image signal VID1 to be supplied to the first data line 114*a* of each block, and outputs an image signal VIDa1. For example, the image signal VIDa1 held to be applied to the n-th block is an image signal VID1n.

Thereafter, the correction circuit 311 produces the correcting signal VID1' according to the image signal VID1 and pre-charging voltage Vpre. The phase development circuit 301 expands the input image signal VID in terms of a time base, converts it from a serial form to a parallel form according to the number of data lines 114 constituting each block, and thus produces parallel-form image signals VID1 to VID6. If the number of image signals into which the input image signal is developed is N, the cycle of the input image signal is expanded to be N times longer. Image signals of N channels determined with N phases of the input image signal are produced. In the present embodiment, since N=6, the cycle of the input image signal is expanded to be six times longer, and the image signals VID1 to VID6 of six channels are produced. The image signals VID1 to VID6 have, as shown in FIG. 2, the timings of their being sampled coincided with one other.

The addition circuit 312 produces an image signal VID6' by adding up the image signal VID6 and correcting signal VID1'. The image signal VID6' lags behind the image signals VID1 to VID6 by a delay time ΔT caused by the addition circuit 312. The second sample-and-hold circuit 312 is intended to absorb the delay time. Namely, the second sample-and-hold circuit 312 samples and holds the input signals in response to the sample-and-hold signal SH2, and outputs the image signals VID1 to VID5 and VID6' that are in phase with one another.

Figure 3:
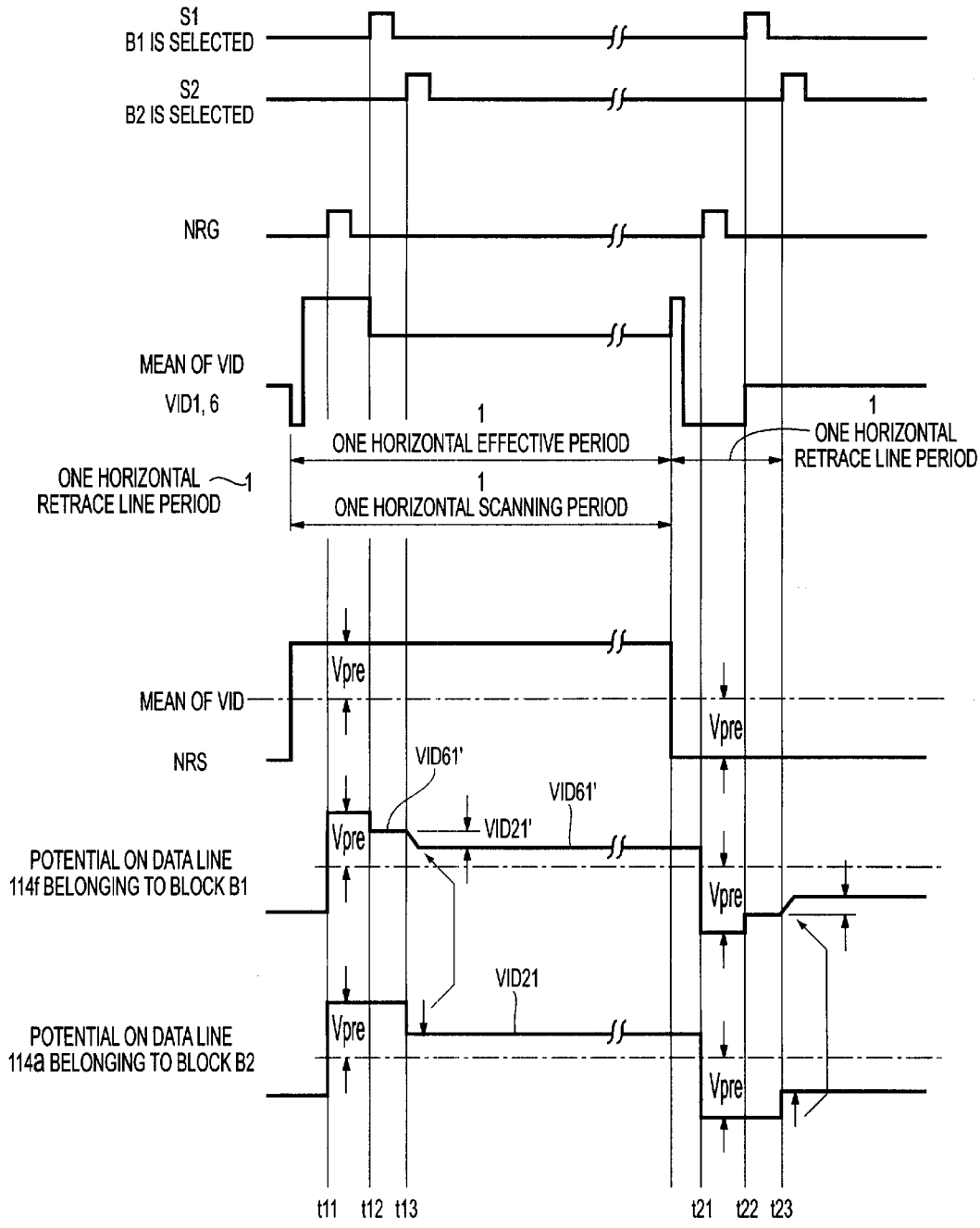
FIG. 3 is a timing chart indicating actions performed in a liquid crystal display panel.

Next, a voltage to be applied to the data lines will be described below. FIG. 3 is a timing chart for explaining actions to be performed in the liquid crystal display panel 100, and is analogous to FIG. 16 referred to in relation to the related art. As shown in FIG. 3, the voltage level of the pre-charging signal NRS is associated with a substantially black level of a gray scale in a normally-white mode. The pre-charging signal NRS is output from the timing signal generation circuit 200. The pre-charging signal NRS is synchronous with the image signals VID1 to VID6' (FIG. 3 shows VID1 and VID6' alone), assumes the same polarity as the image signals VID1 to VID6', and has the polarity thereof reversed for each scanning line.

Referring to FIG. 3, the pre-charge driving signal NRG is driven high at a timing t11 within a time interval within which the image signals applied are of positive polarity. All the switches 165 are therefore turned on. The data lines 114*a* to 114*f* belonging to the blocks B1 to Bm are pre-charged to the level of the pre-charging voltage Vpre through the switches 165. Thereafter, the pre-charge driving signal NRG is driven low. All the data lines hold the pre-charging voltage Vpre because of their parasitic capacitors.

The sampling signal S1 is driven high at a timing t12. Since the image signal VID61' is sampled through the switch 131, the potential on the data line 114*f* belonging to the block B1 changes from the level of the pre-charging voltage Vpre to the voltage level of the image signal VID61'. The resultant potential is written in a pixel location defined along a currently-selected scanning line by means of an associated TFT 116. Thereafter, the sampling signal S1 is driven low.

The sampling signal S2 is driven high at a timing t13. Since an image signal VID21 is sampled through the switch 131, the potential on the data line 114*a* belonging to the block B2 changes from the level of the pre-charging voltage Vpre, which has been held so far, to the voltage level of the sampled image signal VID21. The resultant potential is written in a pixel location defined along the currently-selected scanning line by an associated TFT 116.

The data line 114*f* belonging to the block B1 and located on the right edge of the block B1 (in other words, adjoining the block B2) is capacitively coupled to the data line 114*a* of the block B2 with a liquid crystal layer between them. When the voltage on the data line 114*a* belonging to the block B2 changes from the level of the pre-charging voltage Vpre to the voltage level of the sampled image signal VID1, the voltage on the data line 114*f* fluctuates while being affected by the voltage change.

However, as shown in FIG. 3, a voltage applied to the data line 114*f* belonging to the block B1 during a time interval from a timing t12 to a timing t13 is the signal VID61' (=VID61+VID21'). Namely, the correcting signal VID21' is added to the signal VID61 that should primarily be applied. The correcting signal VID21' is, as mentioned above, set to a voltage level canceling out noise.

The voltage on the data line 114*a* belonging to the block B2 changes at the timing t13. Even if noise stemming from the voltage change is placed on the data line 114*f* belonging to the block B1, the noise is canceled out by the correcting signal VID21'. Consequently, at the timing t13, the potential on the data line 114*a* of the block B1 changes to the potential level of the signal VID61 that should primarily be applied to the data line.

At timings t21, t22, and t23 within a time interval within which the image signals applied are of negative polarity, the same actions as those performed at the timings t11, t12, and t13 are carried out. Moreover, the same actions are performed relative to the other blocks B2 to Bm with the same scanning line selected. Besides, the same actions are performed relative to the other scanning lines.

As mentioned above, the data lines 114*f* located on the right edges of the blocks B1 to Bm hold a primary writing potential. Consequently, irregular luminance occurring in portions of a displayed image coincident with the borders among the blocks B1 to Bm can be suppressed.

Next, the pre-charging voltage Vpre will be discussed. As mentioned above, the voltage on the data line 114*f* located on the right edge of a certain block fluctuates with a change in the voltage on the adjoining data line 114*a*, or in other words, the data line 114*a* located on the left edge of an adjoining block. The magnitude of a fluctuation in the voltage depends primarily on the capacitance of a coupling capacitor coupling the data lines 114*f* and 114*a* and secondly on the voltage change on the data line 114*a*. The capacitance of the coupling capacitor that couples the data line 114*f* to the data line 114*a* is thought to remain constant while the liquid crystal display device is active. The voltage change on the data line 114*a* is a difference voltage between the pre-charging voltage Vpre and image signal VID21.

Provided the above-described correction is not performed, the difference voltage between the pre-charging voltage Vpre and image signal VID21 must be reduced in order to minimize the irregular luminance occurring in portions of a displayed image coincident with the borders among the blocks. The voltage level of the input image signal VID varies depending on an image to be displayed. The mean voltage level of the input image signal VID is 50% of the peak level thereof. The pre-charging voltage Vpre must therefore be set to zero. However, if the pre-charging voltage Vpre is thus set, when the input image signal VID whose voltage level is associated with a substantially black level of a gray scale in a normally-white mode is applied to the data lines that are capacitive loads, a large potential change occurs on the data lines. Applying the input image signal VID to the data lines cannot therefore be completed for a short period of time. Consequently, it becomes hard to produce sufficient contrast.

In contrast, if the above-described correction is performed, consideration need not be taken into the voltage change. The pre-charging voltage Vpre can be set to a level associated with the substantially black level of a gray scale in the normally-white mode. According to the present embodiment, therefore, the irregular luminance can be suppressed and distinct contrast can be produced.

(Second Exemplary Embodiment)

<Configuration>

An active matrix liquid crystal display device in accordance with the second exemplary embodiment will be described as an example of an electro-optical device. In the present embodiment, an input image signal to be fed to the liquid crystal display device is a digital signal representing input image data D.

Figure 4:
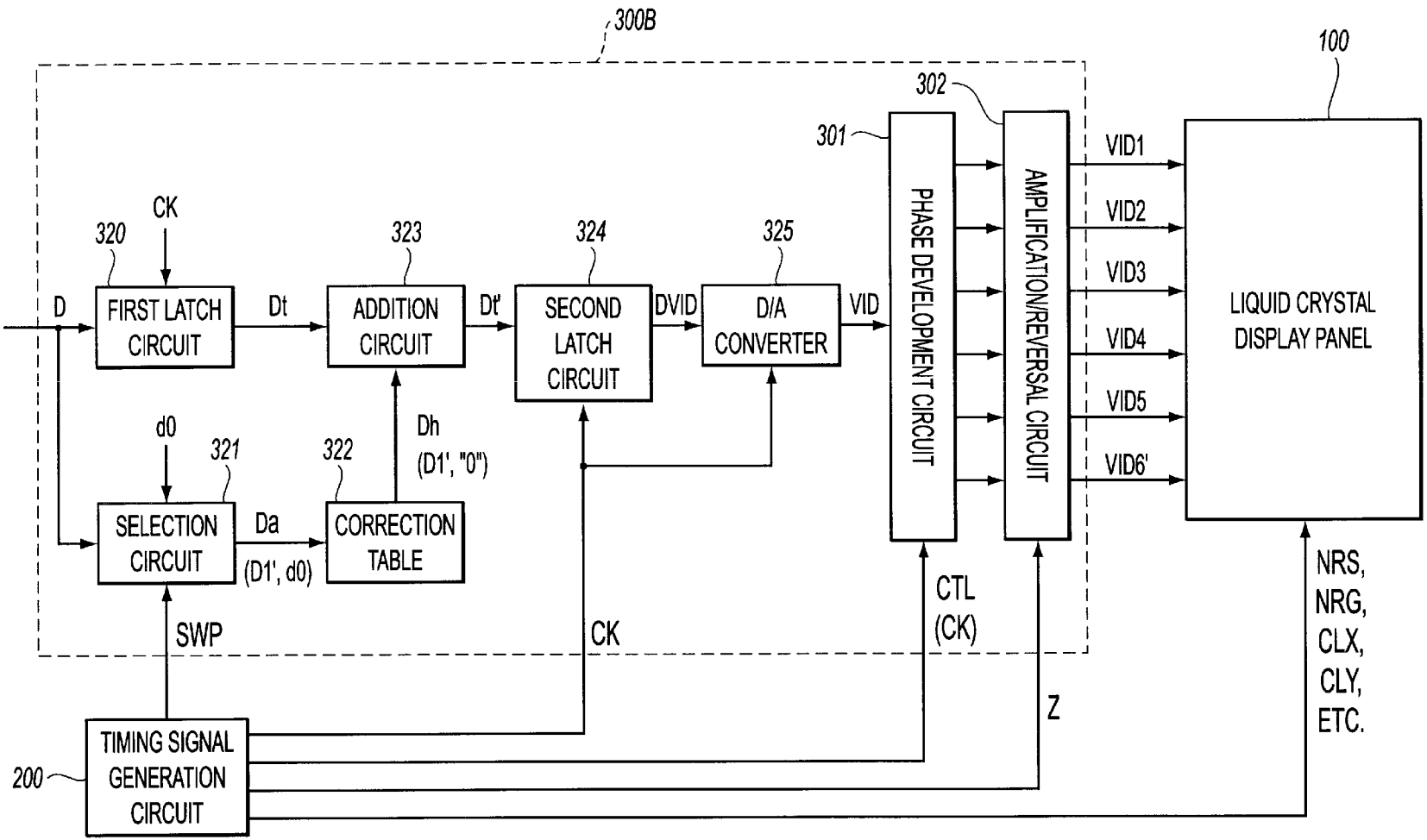
FIG. 4 is a block diagram showing the overall configuration of a liquid crystal display device in accordance with a second exemplary embodiment of the present invention.

FIG. 4 is a block diagram showing the overall configuration of the liquid crystal display device in accordance with the second exemplary embodiment. The liquid crystal display device in accordance with the second exemplary embodiment is different from the one shown in FIG. 15 in a point that a first latch circuit 320, a selection circuit 321, a correction table 322, an addition circuit 323, a second latch circuit 324, and a D/A converter 325 are included in an image processing circuit 300B in efforts to overcome the irregular luminance.

The first latch circuit 320 latches the input image data D synchronously with a clock pulse CK fed from the timing signal generation circuit 200. The first latch circuit 320 then outputs image data Dt lagging behind the input image data D by a sampling period during which one sample of the input image data is acquired.

The selection circuit 321 selects the input image data D or data d0 according to a switching pulse SWP output from the timing signal generation circuit 200. Specifically, when the switching pulse SWP is high, the input image data D is selected and output. When the switching pulse SWP is low, the data d0 is selected and output. The switching pulse SWP is output for each block, and remains high during one sampling period immediately after handling a block is started.

Assuming that image data items D1 to D6 represent voltage levels to be applied to the data lines 114*a* to 114*f* belonging to each block, output data Da of the selection circuit 321 represents the same voltage levels as those represented by the image data D1 and data d0. The data d0 represents a voltage level corresponding to the pre-charging voltage Vpre.

The correction table 322 is used to produce correction data Dh representing a voltage level equivalent to noise according to the output data Da. Voltage level to be represented by the image data D1 are stored in association with those to be represented by the correction data Dh in the correction table 322. The correction data Dh is pre-defined based on a difference between a voltage level represented by the image data D1 and the level of the pre-charging voltage Vpre, so that the noise can be canceled. Since the pre-charging voltage Vpre is predefined, the ratio of the correction data Dh to the image data D1 is 1:1. In other words, in the correction table 322, the voltage levels to be represented by the image data D1 are stored in association with those to be represented by the correction data Dh in consideration of the pre-charging voltage Vpre.

When the voltage level represented by the image data D1 agrees with the level. of the pre-charging voltage Vpre, even if a voltage to be applied to the data line 114*a* is changed from the pre-charging voltage Vpre to the image signal, no voltage change occurs. This means that no noise occurs. Therefore, in this case, the correction data Dh represents 0. By the way, the data d0 represents a voltage level corresponding to the pre-charging voltage Vpre. When the data d0 is placed in the correction table 322, the correction data Dh representing 0 is output from the correction table 322.

The addition circuit 323 adds up the output data Dt of the first latch circuit 320 and the correction data Dh so as to produce image data Dt'. The second latch circuit 324 latches the image data Dt' synchronously with the clock pulse CK and outputs image data DVID. The D/A converter 325 converts the image data DVID from a digital form to an analog form so as to produce an image signal VID.

The other components are identical to those of the liquid crystal display device of FIG. 15. The reiteration of the components will not be needed.

<Actions>

Figure 5:
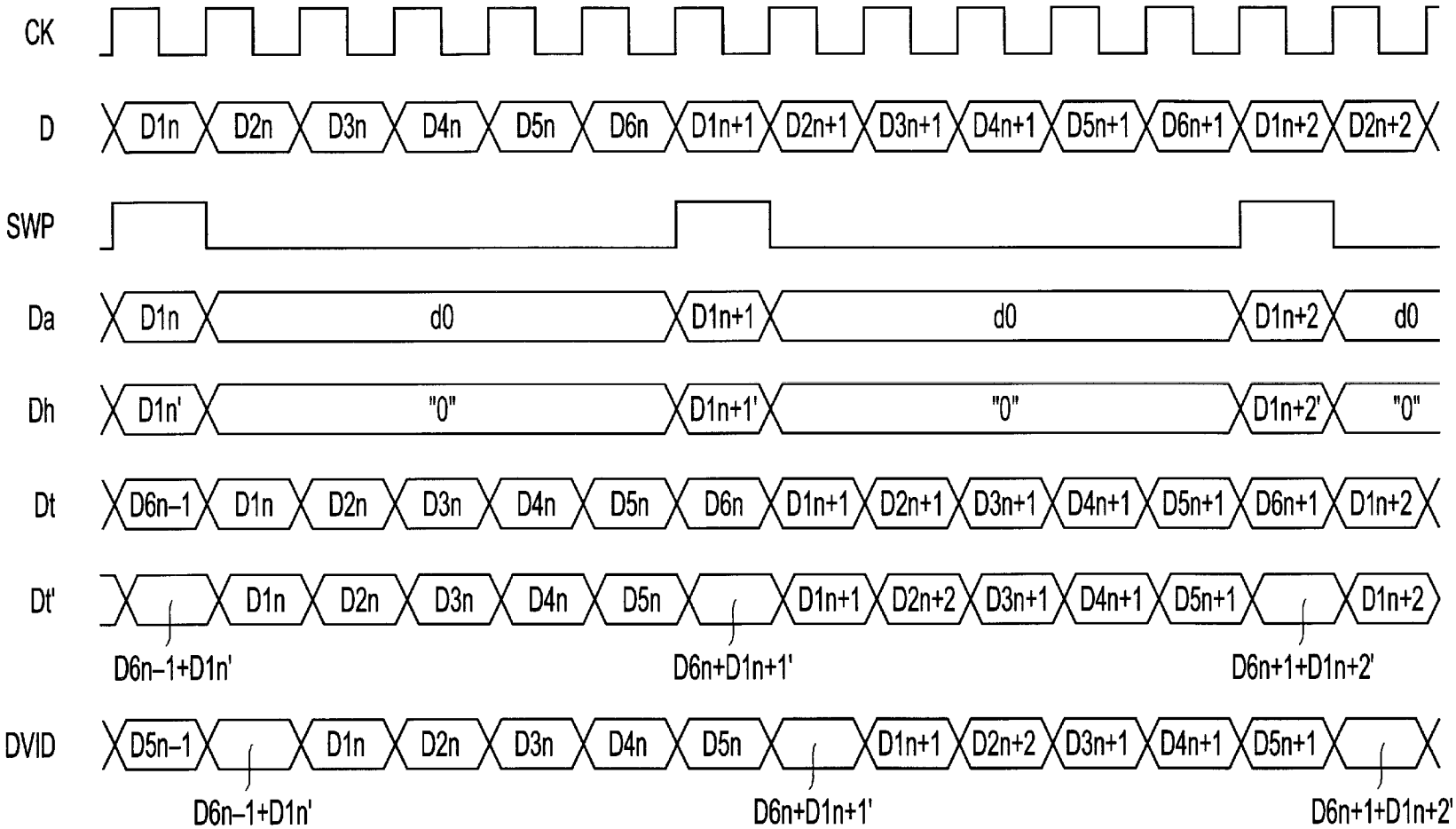
FIG. 5 is a timing chart indicating actions performed in an image display circuit incorporated in the liquid crystal display device of FIG. 4.

Next, actions to be performed in the liquid crystal display device will be described below. FIG. 5 is a timing chart for explaining actions to be performed in the image processing circuit 300B. In the drawing, a letter X included in DXY specifies a data line preceded by X−1 data lines in a block when the data lines constituting the block are counted in a direction of scanning. A letter Y therein specifies a block preceded by Y−1 blocks. For example, 1n+1 of D1n+1 specifies the first data line of the n+1-th block.

The timing signal generation circuit 200 produces the clock pulse CK according to the samples of the input image data D. The timing signal generation circuit 200 also produces the switching pulse SWP used to specify the image data D1 representing a voltage level to be applied to the first data line belonging to each block.

When the switching pulse SWP is fed to the selection circuit 321, if the switching pulse SWP remains high, the selection circuit 321 selects the image data D to output the image data D1. If the switching pulse SWP remains low, the data d0 is selected and output. Consequently, the selection circuit 321 provides the output data Da shown in FIG. 5.

When image data items D1n, D1n+1, D1n+2, etc. are placed as the output data Da in the correction table 322, data items D1n', D1n+1', D1n+2', etc. are, as illustrated, output as the correction data Dh from the correction table 322. While the data d0 is placed as the output data Da, the correction data Dh representing 0 is output.

Therefore, the addition circuit 323 adds up the correction data Dh and outputs data Dt to provide data Dt'. that represents the same voltage levels as those represented by data items D6n−1+D1n', D6n+D1n+1', D6n+1+D1n+2', etc. The output data Dt represents the same voltage levels as those represented by data items D6n−1, D6n, D6n+1, etc. and to be applied to the data lines 114*f* of the respective blocks. The addition circuit 323 causes a delay time. The data Dt' therefore lags a little behind the clock pulse CK. The second latch circuit 324 latches the data Dt' to produce image data DVID as shown in FIG. 5.

The voltage levels represented by the image data DVID and to be applied to the data lines 114*f* of the respective blocks have been corrected to cancel noise entering from the data lines 114*a* of the adjoining blocks. The image signal VID produced by converting the image data DVID using the D/A converter 325 is developed into signals exhibiting phases of the image signal VID, amplified, and reversed in polarity. This results in the image signals VID1 to VID5 and VID6' that are identical to those employed in the first exemplary embodiment. The actions to be performed in the liquid crystal display panel 100 are therefore identical to those performed in the first exemplary embodiment and described in conjunction with FIG. 3. Specifically, when the potential on the data line 114*a* of a certain block changes from the level of the pre-charging voltage, noise corresponding to the difference voltage may enter the data line 114*f* of an immediately preceding block. In this case, the noise is canceled. Consequently, the data lines 114*f* located on the right edges of the blocks B1 to Bm hold their primary writing voltages. Eventually, irregular luminance occurring in portions of a displayed image coincident with the borders among the blocks B1 to Bm can be suppressed.

(Third Exemplary Embodiment)

Figure 6:
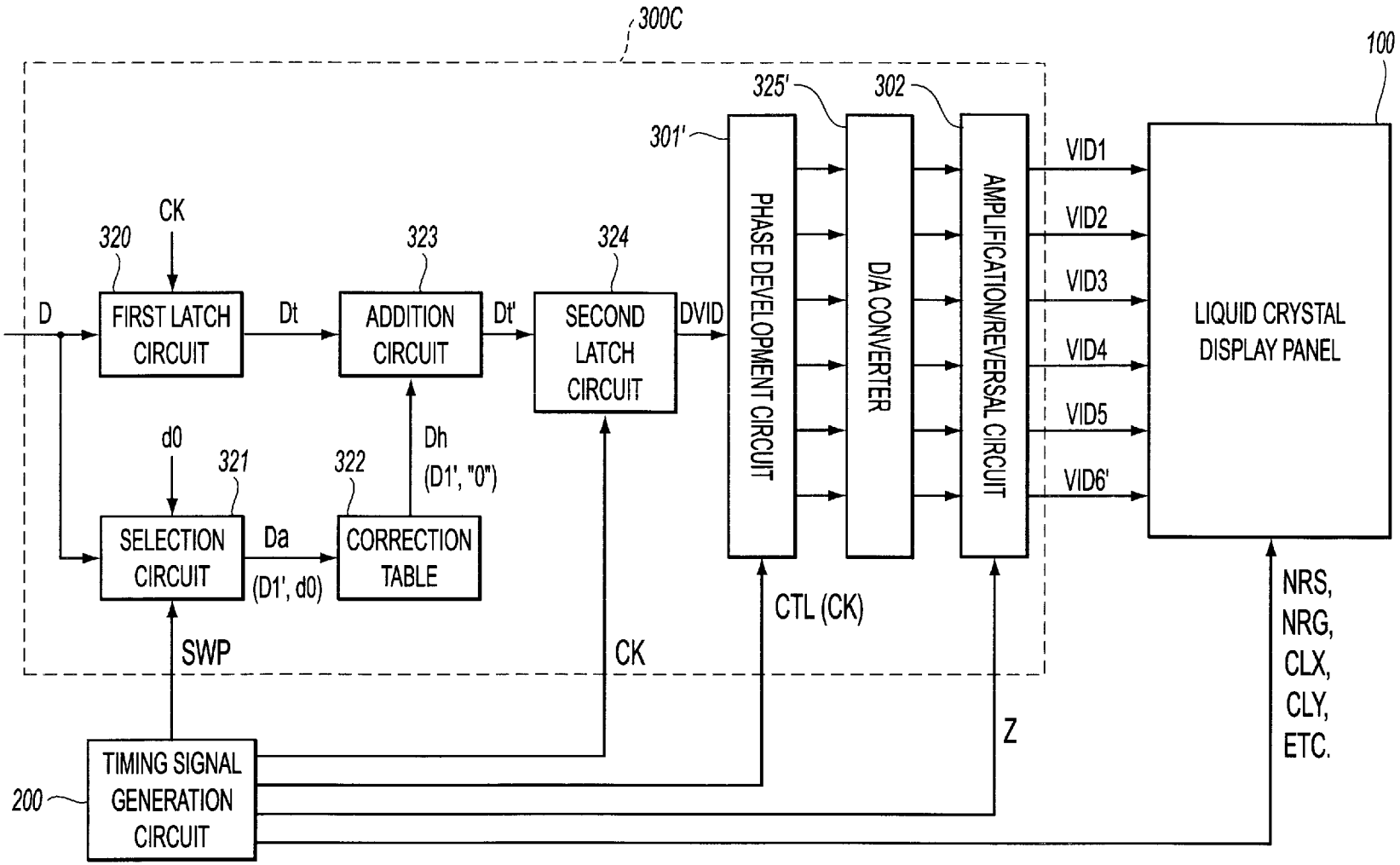
FIG. 6 is a block diagram showing the overall configuration of a liquid crystal display device in accordance with a third exemplary embodiment of the present invention.

The third exemplary embodiment is, like the second exemplary embodiment, concerned with a liquid crystal display device in which an input image signal is a digital signal representing image data D. FIG. 6 is a block diagram showing the overall configuration of the liquid crystal display device in accordance with the third exemplary embodiment. The liquid crystal display device of this embodiment is different from the liquid crystal display device in accordance with the second exemplary embodiment shown in FIG. 4 in points described below. Namely, the D/A converter 325 is excluded and the image data DVID is therefore fed directly to a phase development circuit 301'. The phase development circuit 301' is realized with a digital circuit. A D/A converter 325' receiving six inputs and providing six outputs is interposed between the phase development circuit 301' and amplification/reversal circuit 302.

In general, a phase development circuit for developing an analog signal into signals exhibiting phases of the signal requires a plurality of sample-and-hold circuits numbering the same as the number of signals into which the analog signal is developed. If the capacitance of a holding capacitor included in each sample-and-hold circuit varies, the gain produced by the sample-and-hold circuit becomes different from those produced by the other sample-and-hold circuits. For this reason, a high-precision holding capacitor must be employed.

According to the present embodiment, since the phase development circuit 301' realized with a digital circuit is employed, a digital signal can be developed into signals exhibiting phases of the signal and having high quality.

(Fourth to Sixth Exemplary Embodiments)

<Overview>

In the above-described first to third exemplary embodiments, a change in the potential on the data line 114*a* belonging to a succeeding block is calculated as a difference voltage between the pre-charging voltage Vpre and an image signal to be applied to the data line 114*a*. The image signal to be applied to the data line 114*f* belonging to the block is corrected based on the potential change.

Figure 16:
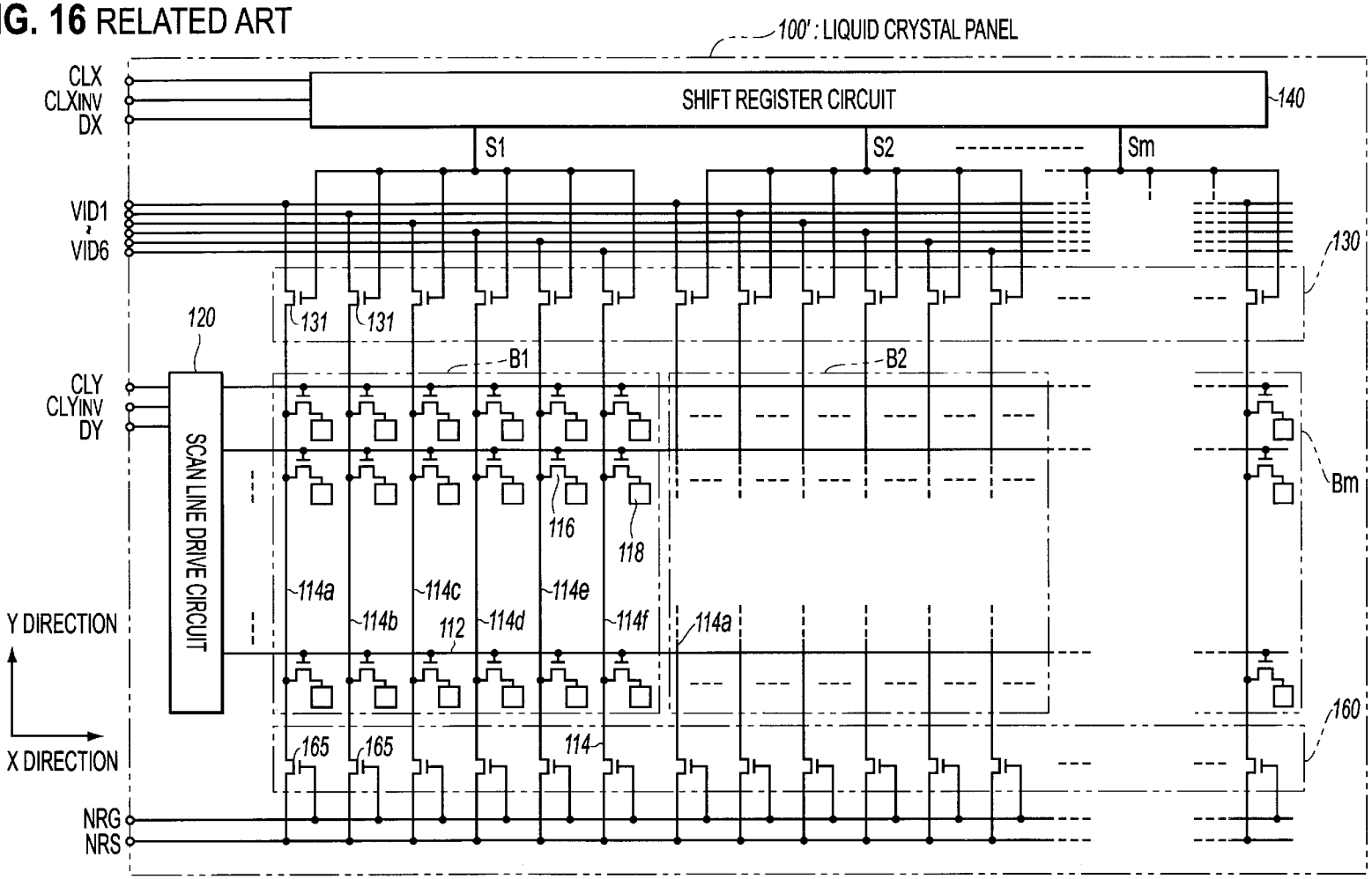
FIG. 16 RELATED ART
FIG. 16 is a block diagram showing the electrical configuration of a liquid crystal display panel included in the conventional liquid crystal display device of FIG. 15.
Figure 17:
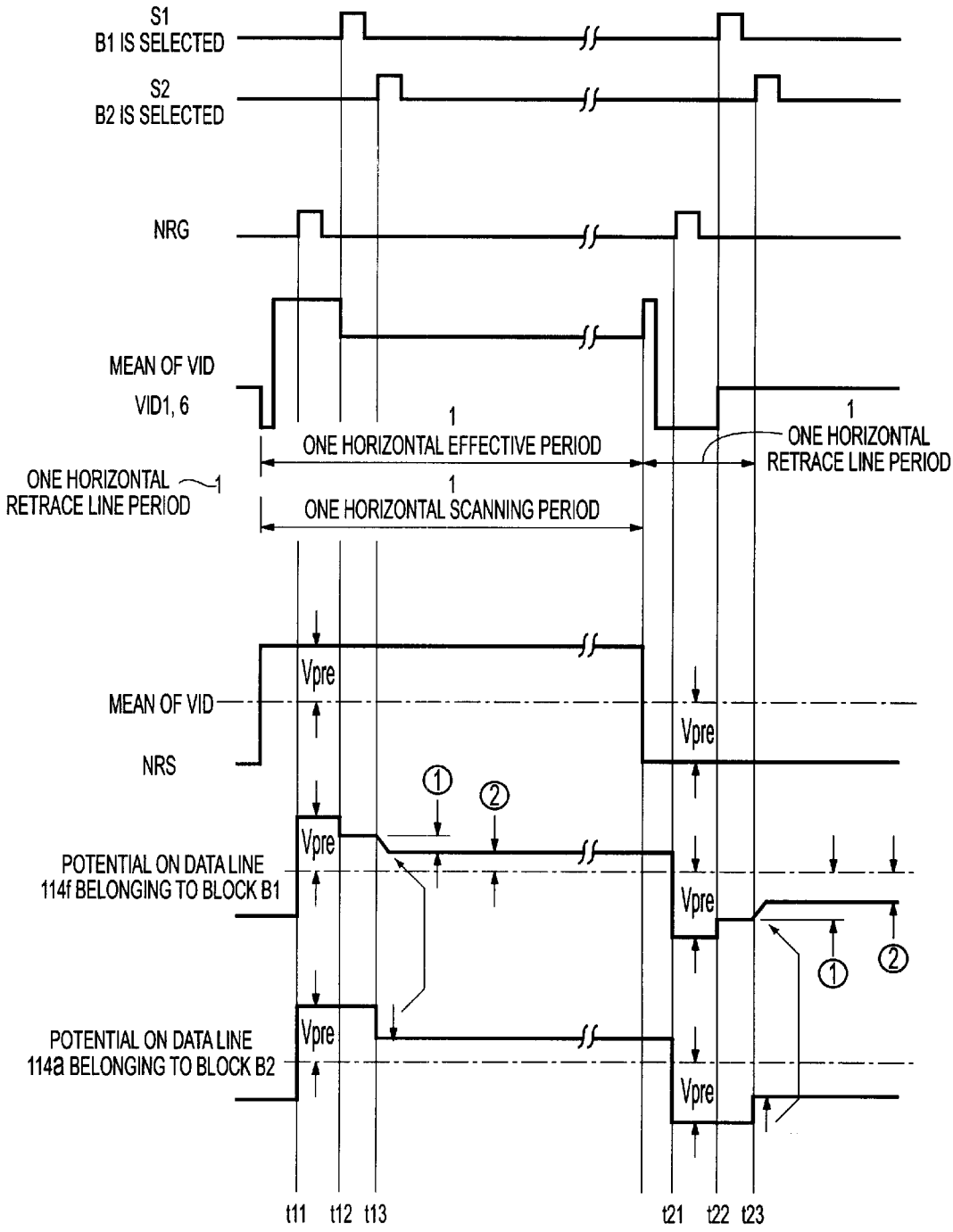
FIG. 17 RELATED ART
FIG. 17 is a timing chart indicating actions performed in the conventional liquid crystal display device of FIG. 15.

The sampling circuit 130 shown in FIG. 16 has, as mentioned above, the plurality of switches 131 formed with n-channel TFTs. Image signals are supplied to the sources of the switches 131, and the data lines 114 are coupled to the drains thereof. A voltage drop occurring between the source and drain of each switch 131 varies depending on the source voltage thereof. To be more specific, as the source voltage decreases, a phenomenon that the voltage drop between the source and drain increases takes place. Incidentally, the phenomenon is referred to as a pushdown.

By the way, when a direct voltage is applied to a liquid crystal, the characteristics of the liquid crystal deteriorate. In the above-described embodiments, therefore, the polarity of image signals is reversed with the potential on the opposite substrate as a reference at intervals of, for example, one horizontal scanning period according to the polarity reversing signal Z. When the polarity reversing signal Z represents positive polarity, relatively high-voltage image signals are applied to the sources of the switches 131. When the polarity reversing signal Z represents negative polarity, relatively low-voltage image signals are applied to the sources of the switches 131. In other words, when an image signal of positive polarity is applied to each switch 131, the voltage drop between the source and drain of the TFT serving as the switch 131 is limited. When the image signal of negative polarity is applied thereto, the voltage drop between the source and drain of the TFT is large.

As mentioned above, a magnitude of correction of an image signal is determined with the pre-charging voltage Vpre and the image signal to be applied to the data line 114*a* belonging to a succeeding block. The image signal to be applied to the data line 114*a* is susceptible to the pushdown stemming from polarity reversal. In other words, even when an image signal represents one gray-scale level, the voltage drop at the associated switch 131 varies depending on whether the polarity reversing signal Z represents positive or negative polarity.

The fourth to sixth exemplary embodiments to be described later are associated with the above-described first to third exemplary embodiments. The fourth to sixth exemplary embodiments attempt to correct an image signal more accurately in consideration of the voltage drop at the associated switch 131 stemming from polarity reversal. The fourth to sixth embodiments are thus intended to minimize more successfully irregular luminance occurring in portions of a displayed image coincident with the borders among the blocks B1 to Bm.

(Fourth Exemplary Embodiment)

An active matrix liquid crystal display device in accordance with the fourth exemplary embodiment will be described below. An input image signal to be fed to the liquid crystal display device is, like that in the first exemplary embodiment, an analog signal.

Figure 7:
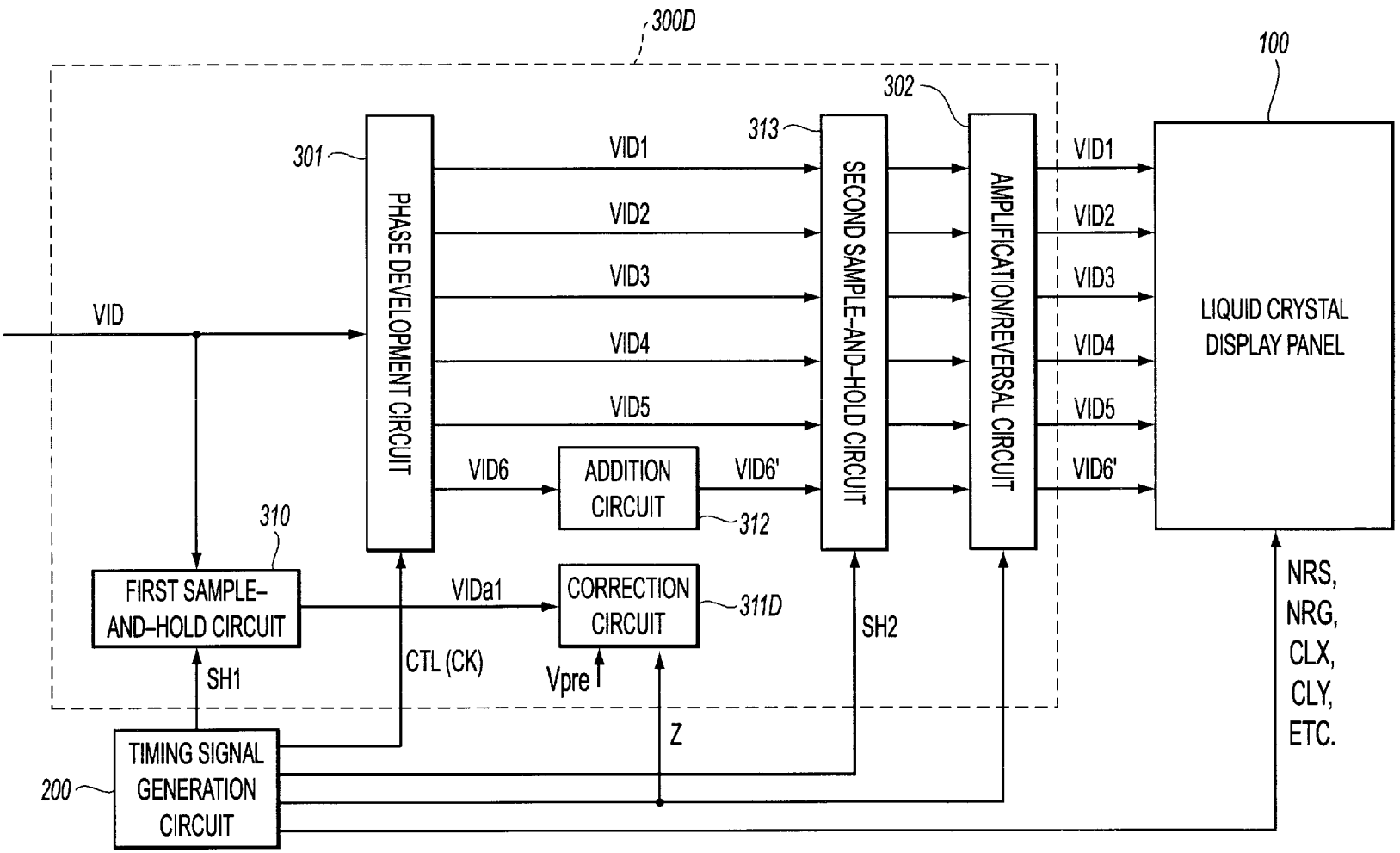
FIG. 7 is a block diagram showing the overall configuration of the liquid crystal display device in accordance with a fourth exemplary embodiment of the present invention.

FIG. 7 is a block diagram showing the overall configuration of a liquid crystal display device in accordance with the fourth exemplary embodiment. The liquid crystal display device in accordance with the fourth exemplary embodiment is identical to the one in accordance with the first exemplary embodiment shown in FIG. 1 except a point that the image processing circuit 300D includes a correction circuit 311D on behalf of the correction circuit 311.

The correction circuit 311D predicts a change in the voltage on the data line 114*a* which causes noise, and predefines a transmission characteristic according to which a signal is transferred from the data line 114*a* to the data line 114*f*. The correction circuit 311D is identical to the correction circuit 311 employed in the first embodiment in a point that a correcting signal VID1' comparable to the noise is produced according to the predicted voltage change and the predefined transmission characteristic. However, the correction circuit 311D is different from the correction circuit 311 in terms of a technique of predicting the voltage change on the data line 114*a*.

Figure 8:
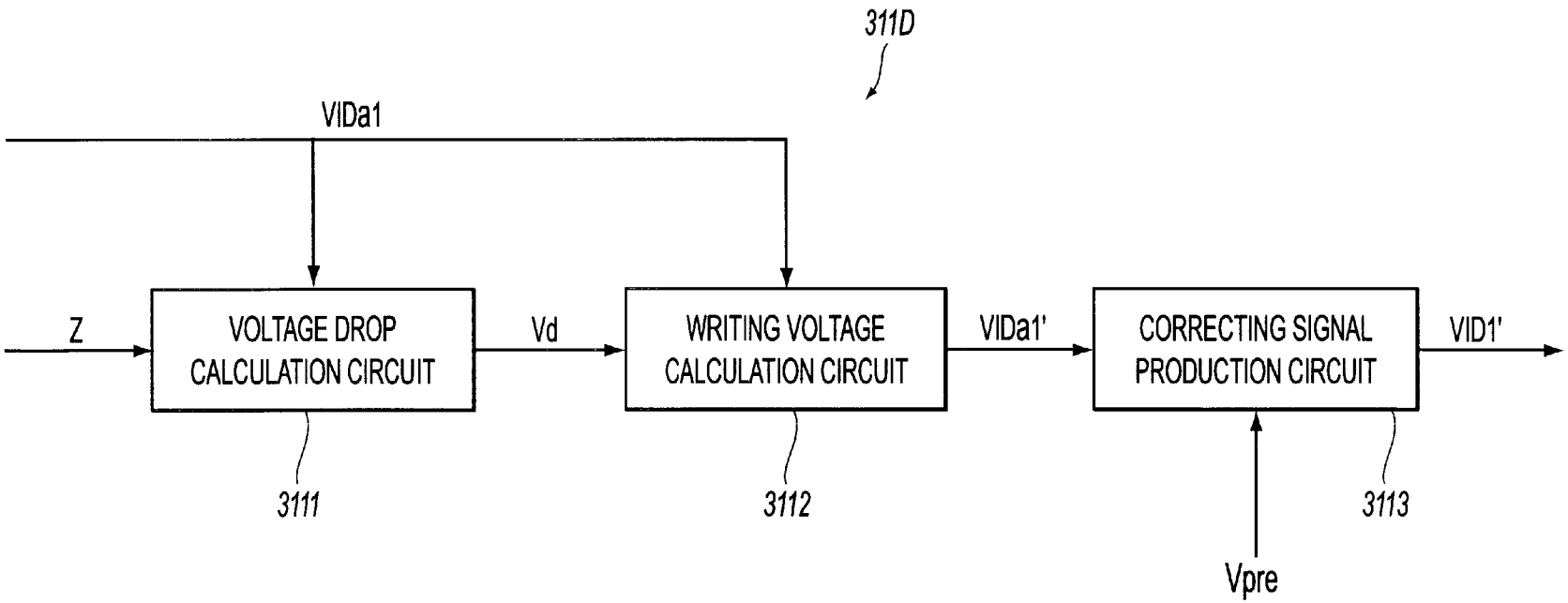
FIG. 8 is a block diagram showing the configuration of a correction circuit employed in the fourth exemplary embodiment.

FIG. 8 is a block diagram showing the functional configuration of the correction circuit 311D. As illustrated, the correction circuit 311D consists of a voltage drop calculation circuit 3111, a writing voltage calculation circuit 3112, and a correcting signal production circuit 3113.

A voltage drop Vd occurring at each switch 131 increases with a decrease in the source voltage of the switch 131. The source voltage is determined uniquely with a voltage level and polarity exhibited by the image signal VIDa1. The voltage drop calculation circuit 3111 calculates the voltage drop Vd at each switch 131 according to the image signal VIDa1 and the polarity reversing signal Z.

The writing voltage calculation circuit 3112 calculates a writing voltage VIDa1', which is applied to the data lines 114*a*, according to the voltage drop Vd and the image signal VIDa1. The correcting signal production circuit 3113 produces a correcting signal VID1' according to the writing voltage VIDa1' and the pre-charging voltage Vpre.

In the correction circuit 311D employed in the fourth exemplary embodiment, the voltage drop Vd at each switch 131 is calculated based on the image signal VIDa1 and the polarity reversing signal Z. The correcting signal VID1' is produced so that the calculated voltage drop Vd will be reflected in the correcting signal. Consequently, a magnitude of correction can be varied with polarity reversal. Eventually, irregular luminance occurring in portions of a displayed image coincident with the borders among the blocks B1 to Bm can be minimized more successfully, and the quality of the displayed image can be improved more greatly.

(Fifth Exemplary Embodiment)

An active matrix liquid crystal display device in accordance with the fifth exemplary embodiment will be described below. An input image signal to be fed to the liquid crystal display device in accordance with the fifth exemplary embodiment is a digital signal as it is in the second exemplary embodiment.

Figure 9:
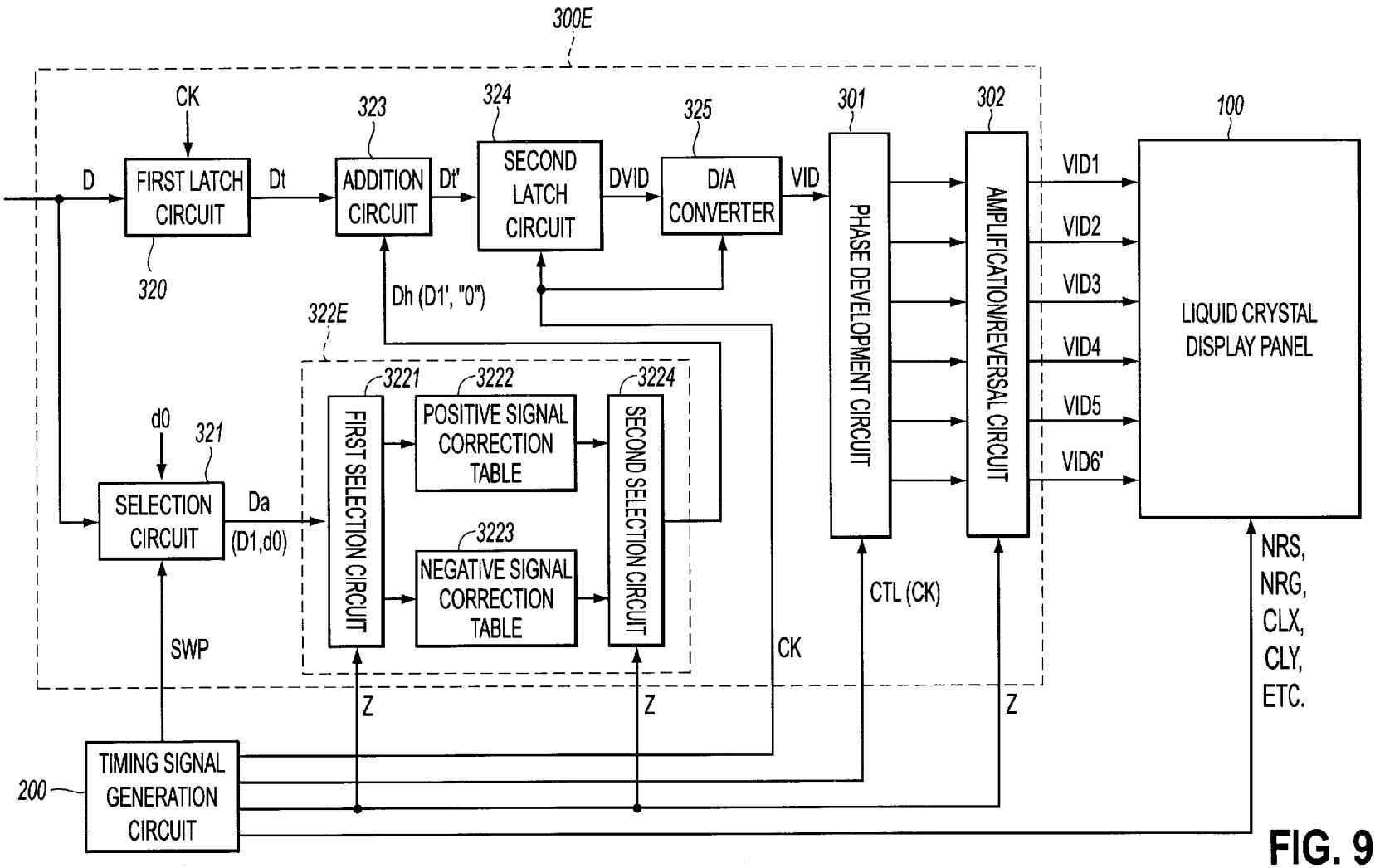
FIG. 9 is a block diagram showing the overall configuration of the liquid crystal display device in accordance with a fifth exemplary embodiment of the present invention.

FIG. 9 is a block diagram showing the overall configuration of the liquid crystal display device in accordance with the fifth exemplary embodiment. The liquid crystal display device in accordance with the fifth exemplary embodiment has the same configuration as the one in accordance with the second exemplary embodiment shown in FIG. 4 except that the image processing circuit 300E includes a correction table circuit 322E on behalf of the correction table 322.

As illustrated, the correction table circuit 322E consists of a first selection circuit 3221, a positive signal correction table 3222, a negative signal correction table 3223, and a second selection circuit 3224.

When the polarity reversing signal Z represents positive polarity, the first selection circuit 3221 places output data Da in the positive signal correction table 3222. When the polarity reversing signal Z represents negative polarity, the first selection circuit 3221 places the output data Da in the negative signal correction table 3223.

Voltage levels to be represented by image data D1 are stored in association with voltage levels to be represented by correction data Dh in the positive signal correction table 3222 and negative signal correction table 3223 respectively. The correction data Dh is predetermined based on a difference between the voltage level represented by the image data D1 and the level of the pre-charging voltage Vpre, so that it will represent a voltage level canceling out noise. To be more specific, the voltage levels to be represented by the correction data Dh and defined in consideration of the voltage drop Vd at each switch 131 that varies depending on the source voltage of the switch are stored in the tables 3222 and 3223.

When the polarity reversing signal Z represents positive polarity, the second selection circuit 3224 selects output data read from the positive signal correction table 3222. When the polarity reversing signal Z represents negative polarity, the second selection circuit 3224 selects output data read from the negative signal correction table 3223. The output data is fed as the correction data Dh to the addition circuit 323.

The components other than the correction table circuit 322E are identical to those of the liquid crystal display device in accordance with the second exemplary embodiment. The iteration of the components will not be needed.

In the correction table circuit 322E employed in the fifth exemplary embodiment, the positive signal correction table 3222 and negative signal correction table 3223. in which the voltage drop Vd is reflected are discretely prepared. Either of the tables is selected based on the polarity reversing signal Z. Image data can be corrected based on the correction data Dh in which the voltage drop Vd is reflected. The magnitude of correction can be varied with polarity reversal. Consequently, irregular luminance occurring in portions of a displayed image coincident with the borders among the blocks B1 to Bm can be minimized more successfully, and the quality of the displayed image can be improved more greatly.

(Sixth Exemplary Embodiment)

Figure 10:
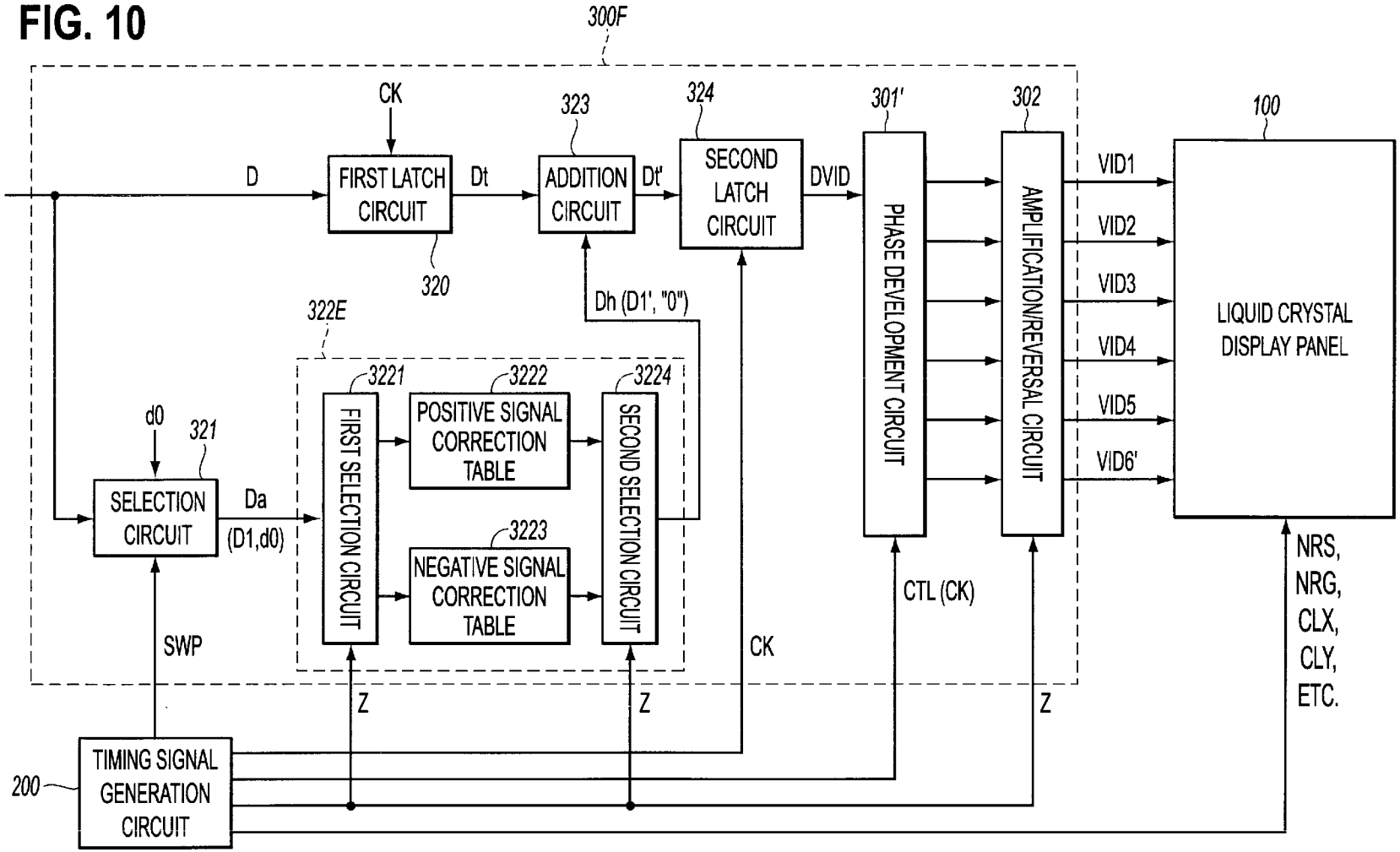
FIG. 10 is a block diagram showing the overall configuration of the liquid crystal display device in accordance with a sixth exemplary embodiment of the present invention.

The sixth exemplary embodiment is, like the third exemplary embodiment, concerned with a liquid crystal display device in which an input image signal is a digital signal representing image data D. FIG. 10 is a block diagram showing the overall configuration of the liquid crystal display device in accordance with the sixth exemplary embodiment. The liquid crystal display device has the same configuration as the liquid crystal display device in accordance with the third exemplary embodiment shown in FIG. 6 except that the image processing circuit 300F includes a correction table circuit 322E on behalf of the correction table 322.

The liquid crystal display device shown in FIG. 10 has, in addition to the same components as those of the liquid crystal display device shown in FIG. 6, the correction table circuit 322E employed in the fifth exemplary embodiment. Similarly to the fifth exemplary embodiment, in the present embodiment, the liquid crystal display device has the positive signal correction table 3222 and negative signal correction table 3223, in which the voltage drop Vd is reflected, prepared discretely. Either of the tables is selected based on the polarity reversing signal Z. The image data can therefore be corrected based on the correction data Dh in which the voltage drop Vd is reflected. Consequently, the magnitude of correction can be varied with polarity reversal. Eventually, irregular luminance occurring in portions of a displayed image coincident with the borders among the blocks B1 to Bm can be minimized more successfully, and the quality of the displayed image can be improved more greatly.

In addition, according to the present embodiment, since the phase development circuit 301' is realized with a digital circuit, the image data can be developed into data items representing phases represented by the image data and having high quality.

(Seventh Exemplary Embodiment)

According to the second exemplary embodiment, correction data is predefined based on a difference between a voltage level represented by image data and the level of a pre-charging voltage. In contrast, according to the present embodiment, the correction data is predefined based on the voltage level represented by the image data.

The same reference numerals will be assigned to components identical to those of the second exemplary embodiment. The description of the components will be omitted.

An active matrix liquid crystal display device in accordance with the seventh exemplary embodiment will be described as an example of an electro-optical device. According to the present embodiment, an input image signal to be fed to the liquid crystal display device is a digital signal representing image data D.

Figure 11:
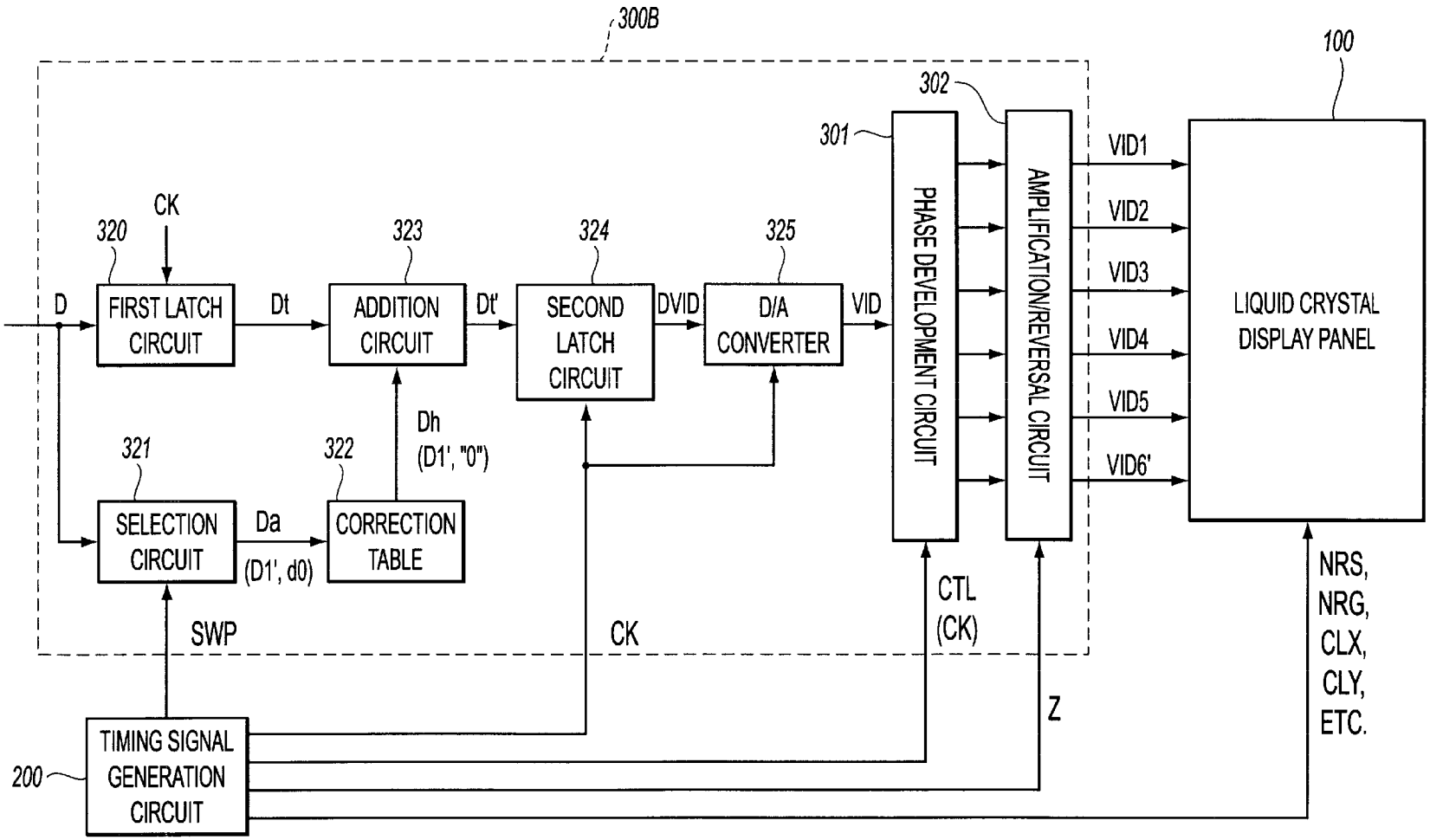
FIG. 11 is a block diagram showing the overall configuration of the liquid crystal display device in accordance with a seventh exemplary embodiment of the present invention.

FIG. 11 is a block diagram showing the overall configuration of a liquid crystal display device in accordance with the seventh exemplary embodiment. The liquid crystal display device in accordance with the seventh exemplary embodiment includes the image processing circuit 300B in efforts to overcome irregular luminance. The image processing circuit 300B consists of the first latch circuit 320, the selection circuit 321, the correction table 322, the addition circuit 323, the second latch circuit 324, and the D/A converter 325.

The first latch circuit 320 latches the input image data D synchronously with the clock pulse CK output from the timing signal generation circuit 200. The first latch circuit 320 provides image data Dt lagging behind the input image data D by one sampling period during which one sample of the input image data is acquired.

The selection circuit 321 selects the input image data D according to the switching pulse SWP output from the timing signal generation circuit 200. Specifically, when the switching pulse SWP is high, the selection circuit 321 selects and inputs the input image data D. Incidentally, the switching pulse SWP is output for each block and remains high during one sampling period immediately after handling a block is started.

Assuming that samples of the input image data representing voltage levels to be applied to the data lines 114*a* to 114*f* of each block are image data items D1 to D6, the output data Da of the selection circuit 321 represents the same voltage level as the image data D1.

The correction table 322 is used to produce the correction data Dh, which represents a voltage level comparable to noise, according to the output data Da. In the correction table 322, voltage levels to be represented by the image data D1 are stored in association with voltage levels to be represented by the correction data Dh. The voltage levels to be represented by the correction data Dh depend on the voltage levels to be represented by the image data D1.

The addition circuit 323 adds up the output data Dt of the first latch circuit 320 and the correction data Dh so as to produce image data Dt'. The second latch circuit 324 latches the image data Dt' synchronously with the clock pulse CK so as to output image data DVID. Moreover, the D/A converter 325 converts the image data DVID from a digital form to an analog form, and thus produces an image signal VID.

The other components are identical to those of the liquid crystal display device of FIG. 15. The iteration of the components will not be needed.

According to the seventh exemplary embodiment, the voltage levels to be represented by the image data D1 are stored in association with the voltage levels to be represented by the correction data Dh in the correction table 322. Consequently, irregular luminance occurring in portions of a displayed image coincident with the borders among the blocks can be suppressed.

EXAMPLES (1) The liquid crystal display device may be adapted to a video projector and used to form an image. The video projector may be installed on the floor or hung from the ceiling with the bottom thereof attached to the ceiling. When the use states are switched, the positional relationship of a liquid crystal panel to a screen is reversed vertically and laterally. It is therefore necessary to reverse a direction of scanning, in which the liquid crystal panel is scanned, vertically and laterally.

Figure 12A:
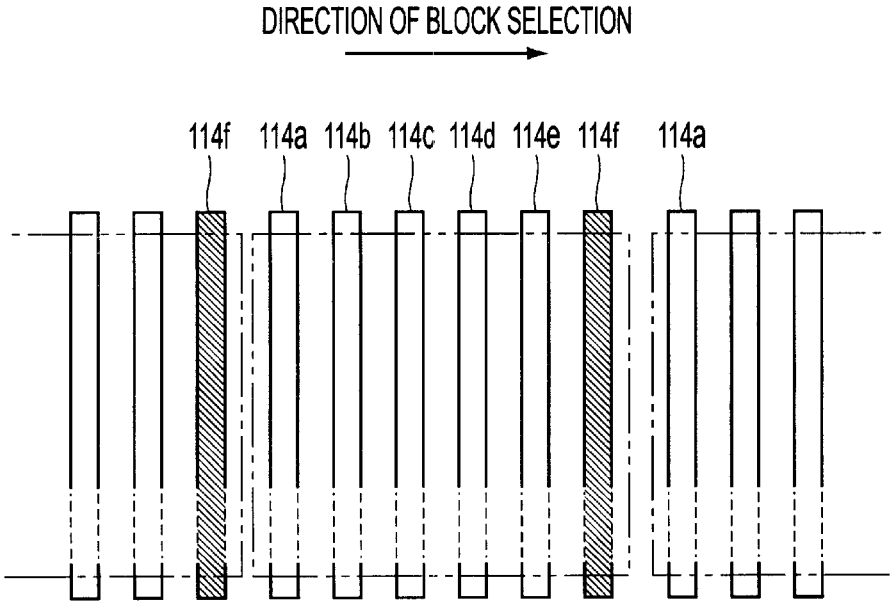
FIG. 12A shows data lines affected by noise when a direction of block selection is a direction from left to right.
Figure 12B:
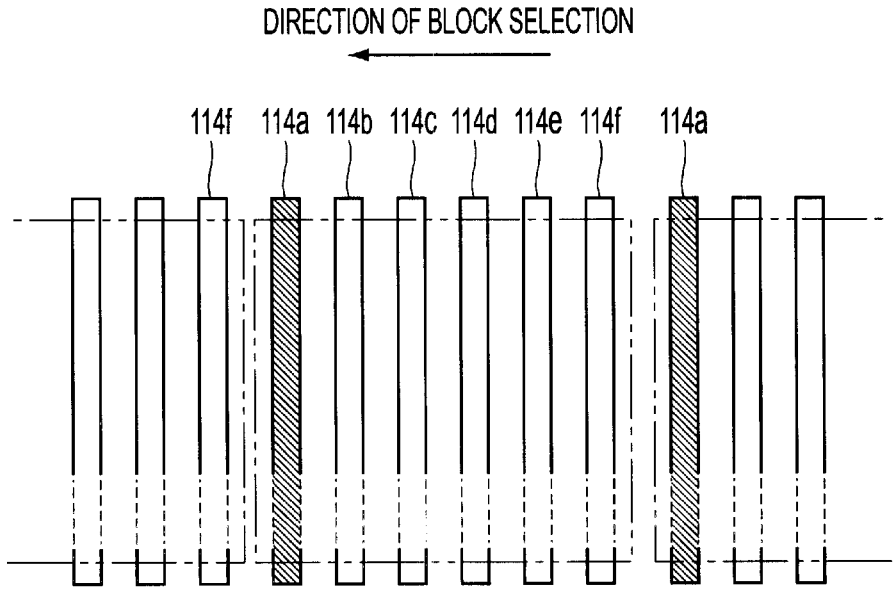
FIG. 12B shows data lines affected by noise when the direction of block selection is a direction from right to left.

In the first to sixth exemplary embodiments, as shown in FIG. 12A, a direction of block selection in which blocks are selected sequentially is a direction from left to right. The data lines 114*f* located on the right edges of the blocks B1 to Bm are affected by noise. The data lines 114*a* adjoining the data lines 114*f* cause the noise. When a direction of scanning in which the data lines are scanned is reversed, the direction of block selection is a direction from right to left as shown in FIG. 12B. In this case, the data lines 114*a* located on the left edges of the blocks B1 to Bm are affected by noise, and the data lines 114*f* adjoining the data lines 114*a* cause the noise. This is attributable to a fact that after a writing voltage is applied to a data line, the data line exhibits a high impedance, and a potential change on an adjoining data line causes noise to enter the data line via a coupling capacitor.

When the directions of block selection are switched, two image memories in which image data representing one field can be stored are installed in a stage preceding the liquid crystal display device. While image data is written in one of the image memories, image data is read from the other image memory and fed to the liquid crystal display device. When image data is read from the image memory, the image data is read in a queue opposite to the one in which the image data is written. Specifically, image data written last is read first. Image data representing a voltage level to be applied to the data line 114*a* affected by noise is fed earlier than image data representing a voltage level to be applied to the data line causing the noise. In other words, even if the direction of block selection is reversed, the sequence of feeding image data items remains unchanged in terms of the noise.

For coping with reversal of the direction of block selection, in the liquid crystal display device of any of the first to sixth exemplary embodiments, a control signal for instructing a direction of transfer is fed to the phase development circuit 301 or 301'. The relationship between the image signals VID1 to VID6' produced by the phase development circuit 301 or 301' to output terminals is reversed based on the control signal. More particularly, when the control signal instructs a forward direction, the image signal VID1 is output through the first output terminal, the image signal VID2 is output through the second output terminal, etc., and the image signal VID6' is output through the sixth output terminal. When the control signal instructs a reverse direction, the image signal VID6' is output through the first output terminal, the image signal VID5 is output through the second output terminal, etc., and the image signal VID1 is output through the sixth output terminal.

(2) In the above-described exemplary embodiments, the blocks B1 to Bm are selected sequentially. The image signals VID1 to VID6 into which an input image signal is developed so that the image signals will exhibit six phases of the input image signal are sampled and supplied simultaneously to the six data lines 114 belonging to a selected block. The number of signals into which the input image signal is developed and the number of data lines to which the image signals are applied simultaneously (the number of data lines constituting one block) are not limited to six. The number of signals into which the input image signal is developed and the number of data lines to which the image signals are applied simultaneously are preferably a multiple of 3 in order to simplify control or circuitry. This is because a color image signal is composed of three signal components representing three primary colors. Therefore, the number of data lines constituting one block may be three, twelve, twenty-four, or the like. Image signals into which an input image signal is developed so that the image signals will exhibit three, twelve, twenty-four phases of the input image signal may be fed in a parallel form and supplied simultaneously.

(3) In the above-described exemplary embodiments, the addition circuit 312 or 323 is used to correct the image signal VID6 or image data Dt. Whether addition or subtraction is adopted as a means for correction depends on the pre-charging voltage and a voltage that is to be applied to a data line causing noise arid that exhibits a level associated with a gray-scale level. In short, the correcting signal or correction data is contained in the image signal or image data so that the noise can be canceled. The addition circuit may therefore be replaced with a synthesizer circuit for synthesizing the image signal with the correcting signal or a synthesizer circuit for synthesizing the image data with the correction data.

(4) In the above-described exemplary embodiments, pre-charging is performed before a block is selected. According to the present invention, a data line that causes noise is specified along with selection of a block. Based on a potential change on the data line, an image signal to be applied to the data line affected by the noise is corrected so that the noise can be canceled. Thus, irregular luminance occurring in portions of a displayed image coincident with the borders among the blocks is suppressed. Therefore, pre-charging may not be performed. In short, an image signal to be supplied to the first data line belonging to a selected block and adjoining to an immediately preceding block is corrected based on an image signal to be applied to the second data line belonging to the immediately preceding block and adjoining to the first data line so that noise can be canceled.

(Electronic Equipment)

A description will be made of some cases where the above-described liquid crystal display device is adapted to electronic equipment.

<Projector>

Figure 13:
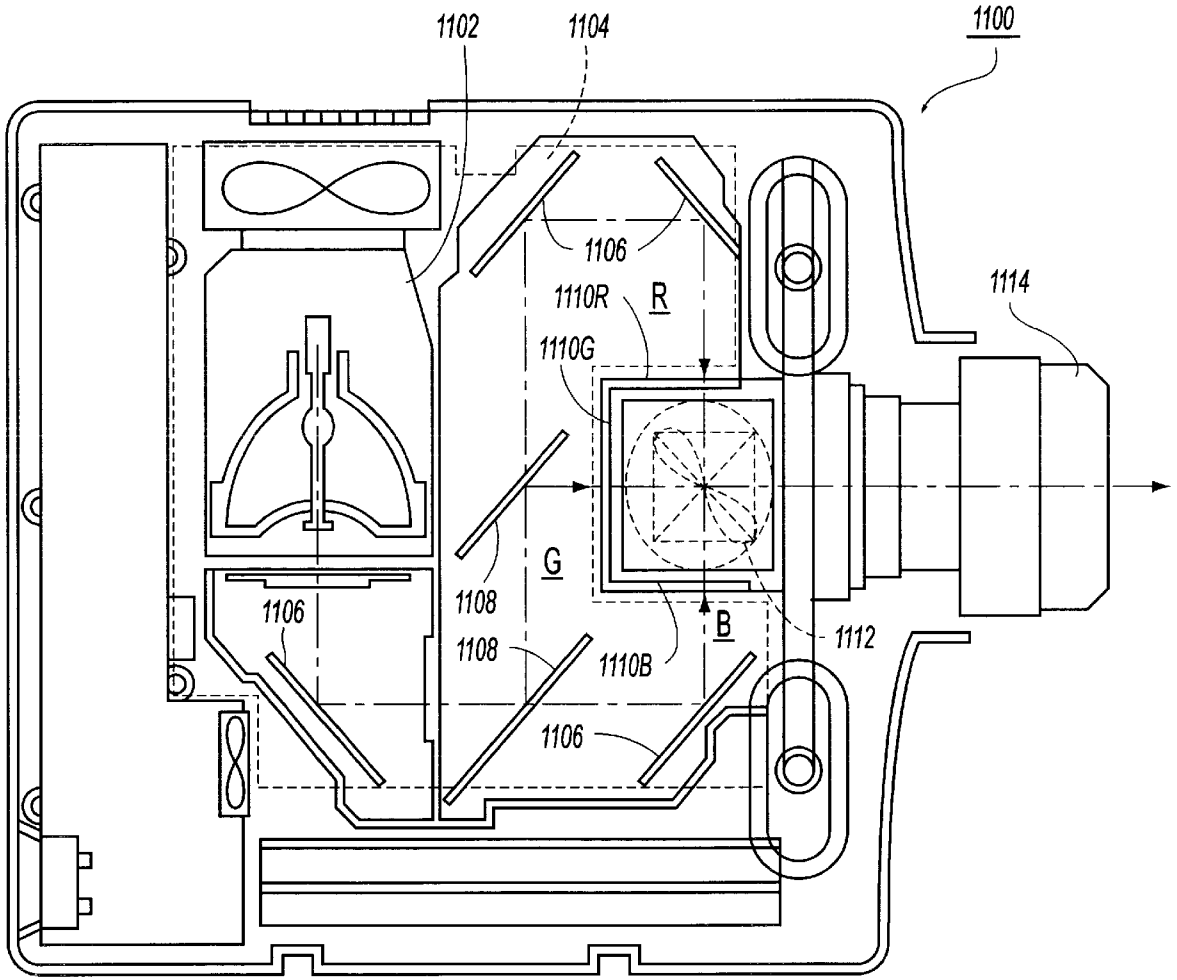
FIG. 13 is a sectional view showing the structure of a liquid crystal projector that is an example of electronic equipment to which the liquid crystal display device in accordance with any of the first to seventh exemplary embodiments is adapted.

To begin with, a projector in which the liquid crystal display device is employed as a light valve will be described below. FIG. 13 is a plan view showing an example of the structure of the projector.

As illustrated, a lamp unit 1102 having a halogen lamp or any other white light source is incorporated in a projector 1100. Projection light emanating from the lamp unit 1102 is split into light rays of three primary colors of red, green and blue by four mirrors 1106 and two dichroic mirrors 1108 which are incorporated in a light guide 1104. The light rays then fall on liquid crystal panels 1110R, 1110B, and 1110G serving as light valves associated with the three primary colors.

The liquid crystal panels 1110R, 1110B, and 1110G have the same configuration as the above-described liquid crystal. display panel 100. The liquid crystal panels are driven with three primary color signals R, G, and B output from an image signal processing circuit that is not shown. The light rays modulated by the liquid crystal panels fall on a dichroic prism 1112 in three directions. The dichroic prism 1112 refracts the red and blue light rays by 90° and passes the green light rectilinearly. The color light rays are therefore synthesized. Consequently, a color image is projected on a screen or the like through a projection lens 1114.

Now, images displayed on the liquid crystal panels 1110R, 1110B, and 1110G will be discussed. The image displayed on the liquid crystal panel 1110G may be turned laterally relative to the images displayed on the liquid crystal panels 1110R and 1110B. A direction of block selection in which the blocks in the liquid crystal panel 1110G are selected sequentially is opposite to the direction of block selection in the liquid crystal panels 1110R and 1110B. The relationship in magnitude between pre-charging signals NRS1 and NRS2 to be fed to the liquid crystal panel 1110G is opposite to the relationship in magnitude between the pre-charging signals NRS1 and NRS2 to be fed to the liquid crystal panel 1110R and 1110B.

The light rays of three primary colors of red, green, and blue are incident on the liquid crystal panels 1110R, 1110B, and 1110G due to the dichroic mirrors 1108. Therefore, a color filter need not be mounted on the opposite substrates of the panels.

<Mobile Computer>

Figure 14:
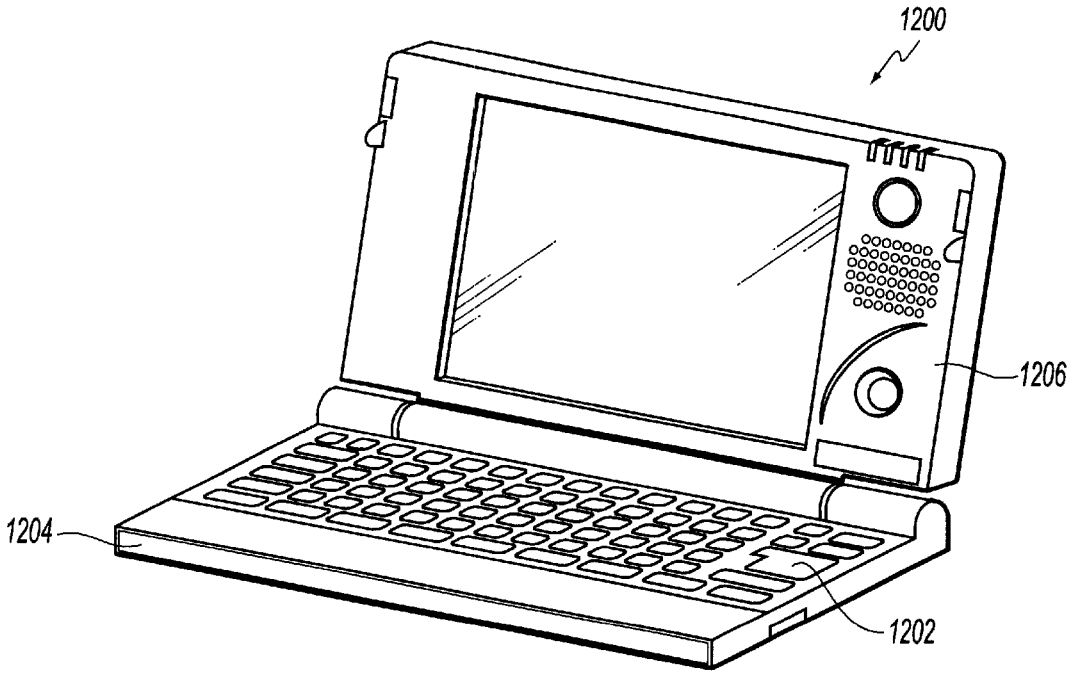
FIG. 14 is a front view showing the appearance of a personal computer that is an example of electronic equipment to which a liquid crystal display device is adapted.

Next, a case where the liquid crystal display device is adapted to a mobile computer will be described below. FIG. 14 is a front view showing the appearance of a computer. In the drawing, a computer 1200 consists mainly of a main body 1204 having a keyboard 1202, and a liquid crystal display unit 1206. The liquid crystal display unit 1206 is realized by adding a backlight to the back of the above-described liquid crystal display panel 100.

Aside from the pieces of electronic equipment described with reference to FIG. 13 and FIG. 14, a liquid crystal television, a viewfinder type video tape recorder, a direct-monitor viewing type video tape recorder, a car navigation system, a pager, an electronic pocketbook, a desktop calculator, a work processor, a workstation, a portable telephone, a television phone, a POS terminal, and an apparatus having a touch-sensitive panel are presented as electronic equipment. The present invention can be implemented in these pieces of electronic equipment.

The present invention has been described by taking for instance an active matrix liquid crystal display device having TFTs. The present invention is not limited to this type of liquid crystal display device. The present invention may also be implemented in a type of liquid crystal display device in which thin film diodes (TFDs) are used as switching elements, and a passive type liquid crystal display device having a super-twisted nematic (STN) liquid crystal. Furthermore, the present invention is not limited to the liquid crystal display device but may be implemented in other types of display devices based on various electro-optical effects including electroluminescence.

What is claimed is:

1. A driving method for an electro-optical device having a plurality of scanning lines, a plurality of data lines, and transistors and pixel electrodes located at intersections between the scanning lines and the data lines, the driving method comprising:

selecting the scanning lines sequentially;

during a period during which each scanning line is selected, applying image signals simultaneously to data lines belonging to each of a plurality of blocks into which the data lines are grouped, the image signals being applied on respective blocks; and correcting in advance an image signal, which is to be applied to a data line of a succeeding block side that belongs to a selected block and adjoining to the succeeding block, according to a predicted change in voltage on a data line of the selected block side belonging to the succeeding block and adjoining to the data line of the succeeding block side in the selected block, wherein a change in voltage in the data line of the selected block side belonging to the succeeding block causes a voltage fluctuation in the data line of the succeeding block side of the selected block, and applying the corrected image signal to the data line of the succeeding block side in the selected block to compensate for voltage fluctuation in the data line of the succeeding block side in the selected block.

2. The driving method for an electro-optical device according to claim 1, the voltage change on said second data line being predicted based on an image signal to be applied to said second data line.

3. The driving method for an electro-optical device according to claim 1, said electro-optical device including sampling transistors for sequentially sampling said image signals and applying them to said data lines; and the voltage change on said second data line being predicted based on an image signal to be applied to said second data line and a voltage drop occurring at an associated sampling transistor.

4. A driving method for an electro-optical device having a plurality of scanning lines, a plurality of data lines, and transistors and pixel electrodes located at intersections between the scanning lines and the data lines, the driving method comprising:

selecting the scanning lines sequentially;

during a period during which each scanning line is selected, applying a pre-charging voltage to each of a plurality of blocks into which the data lines are grouped; and correcting in advance an image signal, which is to be applied to a data line of a succeeding block side that belongs to a selected block and adjoining to the succeeding block, according to a predicted change in voltage on a data line of the selected block side belonging to the succeeding block and adjoining to the data line of the succeeding block side in the selected block, wherein a change in voltage in the data line of the selected block side belonging to the succeeding block causes a voltage fluctuation in the data line of the succeeding block side in the selected block, and applying the corrected image signal to the data line of the succeeding block side in the selected block to compensate for voltage fluctuation in the data line of the succeeding block side in the selected block.

5. The driving method for an electro-optical device according to claim 4, the voltage change on said second data line being predicted based on an image signal to be applied to said second data line and said pre-charging voltage.

6. The driving method for an electro-optical device according to claim 4, said electro-optical device including sampling transistors for sequentially sampling said image signals and applying said image signals to said data lines; and the voltage change on said second data line being predicted based on an image signal to be applied to said second data line, a voltage drop occurring at an associated sampling transistor, and said pre-charging voltage.

7. An image processing circuit for an electro-optical device which has a plurality of scanning lines, a plurality of data lines, and transistors and pixel electrodes located at intersections between the scanning lines and the data lines, in which the scanning lines are selected sequentially, and in which during a period during which each scanning line is selected, parallel-form image signals are applied to each of a plurality of blocks into which the data lines are grouped, the image processing circuit comprising:

a parallel circuit that expands an input image signal in terms of a time base, that converts the input image signal from a serial form to a parallel form according to a number of data lines constituting each of the blocks, and that thus produces a plurality of parallel-form image signals;

a correction circuit that corrects a parallel-form image signal, which is to be applied to a data line of a succeeding block side that belongs to a certain block and adjoining to the succeeding block, according to a predicted change in voltage on a data line of the selected block side belonging to the succeeding block and adjoining to the data line of the succeeding block side in the selected block, wherein a change in voltage in the data line of the selected block side belonging to the succeeding block causes a voltage fluctuation in the data line of the succeeding block side in the selected block; and an output circuit that outputs the corrected parallel-form image signal to compensate for voltage fluctuation in the data line of the succeeding block side in the selected block, together with other parallel-form image signals.

8. The image processing circuit for an electro-optical device according to claim 7, in said electro-optical device, during a period during which each scanning line is selected, after a predetermined pre-charging voltage is applied to said data lines, the parallel-form image signals being applied to each of the blocks into which said data lines are grouped; and said correction circuit predicting the voltage change on said second data line according to a parallel-form image signal to be applied to said second data line and said pre-charging voltage.

9. The image processing circuit for an electro-optical device according to claim 7, said electro-optical device having said scanning lines, said data lines, said transistors, and said pixel electrodes formed on a fist substrate, and having opposite electrodes formed on a second substrate opposed to the substrate;

in said electro-optical device, during a period during which each scanning line is selected, after a predetermined pre-charging voltage is applied to said data lines, the parallel-form image signals being applied to each of the blocks, into which said data lines are grouped, via sampling transistors;

said output circuit combining the corrected parallel-form image signal with other parallel-form image signals, reversing the polarity of signals with a potential at said opposite electrodes as a reference according to a polarity reversing signal of a certain cycle, and outputting resultant signals; and said correction circuit predicting the voltage change on said second data line according to a parallel-form image signal to be applied to said second data line, said pre-charging voltage, and a voltage drop occurring at an associated sampling transistor.

10. The image processing circuit for an electro-optical device according to claim 7, in said electro-optical device, during a period during which each scanning line is selected, after a predetermined pre-charging voltage is applied to said data lines, the parallel-form image signals being applied to each of the blocks into which said data lines are grouped;

the input image signal being an analog signal; and said correction circuit including:

a sample-and-hold circuit that samples and holds said input image signal for each block so as to output a parallel-form image signal to be applied to said second data line;

a correcting signal production circuit that produces a correcting signal according to the parallel-form image signal output from said sample-and-hold circuit and said pre-charging voltage; and a synthesizer circuit that synthesizes a parallel-form image signal, which is output from said parallel circuit and to be corrected, with the correcting signal so as to output a corrected parallel-form image signal.

11. The image processing circuit for an electro-optical device according to claim 9, said input image signal being an analog signal; and said correction circuit comprising:

a sample-and-hold circuit that samples and holds said input image signal for each block so as to output a parallel-form image signal to be applied to said second data line;

a first calculation circuit that calculates said voltage drop according to said parallel-form image signal output from said sample-and-hold circuit and said polarity reversing signal;

a second calculation circuit that calculates a writing voltage to be applied to said second data line according to said voltage drop calculated by said first calculation circuit and said parallel-form image signal output from said sample-and-hold circuit;

a correcting signal production circuit that produces a correcting signal according to said writing voltage and said pre-charging voltage; and a synthesizer circuit that synthesizes the parallel-form image signal, which is output from said parallel circuit and to be corrected, with said correcting signal so as to output the parallel-form image signal.

12. An image processing circuit for an electro-optical device which has a plurality of scanning lines, a plurality of data lines, and transistors and pixel electrodes located at intersections between the scanning lines and the data lines, in which the scanning lines are selected sequentially, and in which during a period during which each scanning line is selected, parallel-form image signals are applied to each of a plurality of blocks into which the data lines are grouped, the image processing circuit comprising:

a correction circuit that specifies an image signal, which is to be applied to a data line of a succeeding block side that belongs to a certain block and adjoining to the succeeding block, by sampling an input image signal, and that corrects the image signal according to a predicted change in voltage on a data line of the selected block side belonging to the succeeding block and adjoining to the data line of the succeeding block side in the selected block, wherein a change in voltage in the data line of the selected block side belonging to the succeeding block causes a voltage fluctuation in the data line of the succeeding block side in the selected block, and a parallel processor that expands an output signal of the correction circuit in terns of a time base, that converts the output signal from a serial form to a parallel form according to a number of data lines constituting each block, and that thus produces a plurality of parallel-form image signals.

13. The image processing circuit for an electro-optical device according to claim 12, said input image signal being a digital signal; and said correction circuit comprising:

a selection circuit that selects said input image signal for each block during one specified sampling period;

a memory circuit in which signal voltage levels are stored in association with correction voltage levels and from which a correcting signal having a voltage level associated with that of an output signal of said selection circuit is output in response to the output signal; and a synthesizer circuit that synthesizes said input image signal with said correcting signal.

14. The image processing circuit for an electro-optical device according to claim 13, in said electro-optical device, during a period during which each scanning line is selected, after a predetermined pre-charging voltage is applied to said data lines, the parallel-form image signals being applied to each of the blocks into which said data lines are grouped; and said correction voltage levels being determined based on said pre-charging voltage and said signal voltage levels.

15. The image processing circuit for an electro-optical device according to claim 13, said memory circuit having a correction table listing voltage levels that is to be applied to said second data line and that are to be represented by image data.

16. The image processing circuit for an electro-optical device according to claim 12, said electro-optical device having said scanning lines, said data lines, said transistors, and said pixel electrodes formed on a first substrate, and having opposite electrodes formed on a second substrate;

in said electro-optical device, during a period during which each scanning line is selected, after a predetermined pre-charging voltage is applied to said data lines, parallel-form image signals being applied to each of the blocks, into which said data lines are grouped, through sampling transistors;

said image processing circuit further comprising a polarity reversing circuit that reverses polarity of the plurality of parallel-form image signals output from said parallel processor with a potential on said opposite electrodes as a reference according to a polarity reversing signal of a certain cycle, and that outputs reverse image signals;

said input image signal being a digital signal representing input image data; and said correction circuit comprising:

a selection circuit that selects said input image data for each block during one specified sampling period;

a first memory circuit in which voltage levels to be represented by image data are stored in association with voltage levels to be represented by correction data that is used to correct an image signal of positive polarity;

a second memory circuit in which voltage levels to be represented by image data are stored in association with voltage levels to be represented by correction data that is used to correct an image signal of negative polarity;

a reader circuit that places output data of said selection circuit in said first memory circuit or said second memory circuit according to said polarity reversing signal, and reading associated correction data; and a synthesizer circuit that synthesizes said input image data with the correction data read by said reader circuit.

17. The image processing circuit for an electro-optical device according to claim 12, said input image signal being a digital signal; and said parallel processor comprising:

a D/A converter that converts a digital output signal of said correction circuit into an analog form; and a parallel circuit that expands an analog output signal of said D/A converter in terms of a time base, that converts said analog output signal from a serial form to a parallel form according to a number of data lines constituting each block, and that thus produces a plurality of analog parallel-form image signals.

18. The image processing circuit for an electro-optical device according to claim 12, said input image signal being a digital signal; and said parallel processor comprising:

a parallel circuit that expands a digital output signal of said correction circuit in terms of a time base, that converts said digital output signal from a serial form into a parallel form according to a number of data lines constituting each block, and that thus produces a plurality of digital parallel-form image signals; and a D/A converter that converts the plurality of digital parallel-form image signals output from said parallel circuit into an analog form so as to output a plurality of analog parallel-form image signals.

19. An electro-optical device, comprising:

the image processing circuit set forth in claim 12;

a scanning line drive circuit that sequentially selects said scanning lines;

a block drive circuit that sequentially selects blocks, into which said data lines are grouped, during a period during which each scanning line is selected, and that applies parallel-form image signals to data lines belonging to a selected block; and a pre-charge circuit that applies a pre-charging voltage to data lines belonging to a block before the block is selected.

20. The electro-optical device according to claim 19, said pre-charge circuit setting said pre-charging voltage to a level associated with a substantially black level of a gray scale or a substantially white level thereof.

21. Electronic equipment using the electro-optical device set form in claim 19 as a display unit.

22. An image processing circuit for an electro-optical device which has a plurality of scanning lines, a plurality of data lines, and transistors and pixel electrodes located at intersections between the scanning lines and the data lines, in which the scanning lines are selected sequentially, and in which during a period during which each scanning line is selected, parallel-form image signals are applied to each of a plurality of blocks into which the data lines are grouped, the image processing circuit comprising:

a parallel circuit means for expanding an input image signal in terms of a time base, converting the output image signal from a serial form to a parallel form according to a number of data lines constituting each block, and producing a plurality of parallel-form image signals;

a correction means for correcting a parallel-form image signal, which is to be applied to a data line of a succeeding block side that belongs to a certain block and adjoining to the succeeding block, according to a predicted change in potential on a data line of the selected block side belonging to the succeeding block and adjoining to the data line of the succeeding block side in the selected block, wherein a change in potential in the data line of the selected block side belonging to the succeeding block causes noise in the data line of the succeeding block side in the selected block; and an output means for outputting the corrected parallel-form image signal to compensate for voltage fluctuation in the data line of the succeeding block side in the selected block, together with other parallel-form image signals.

23. An image processing circuit for an electro-optical device which has a plurality of scanning lines, a plurality of data lines, and transistors and pixel electrodes located at intersections between the scanning lines and the data lines, in which the scanning lines are selected sequentially, and in which during a period during which each scanning line is selected, parallel-form image signals are applied to each of a plurality of blocks into which the data lines are grouped, the image processing circuit comprising:

a correction means for specifying an image signal, which is to be applied to a data line of a succeeding block side that belongs to a certain block and adjoining to the succeeding block, by sampling an input image signal, and correcting the image signal according to a predicted change in voltage on a data line of the selected block side belonging to the succeeding block and adjoining to the data line of the succeeding block side in the selected block, wherein a change in voltage in the data line of the selected block side belonging to the succeeding block causes a voltage fluctuation in the data line of the succeeding block side in the selected block; and a parallel circuit means for expanding an output signal of the correcting means in terms of a time base, converting the output signal from a serial form to a parallel form according to a number of the data lines constituting each block, and (thus producing a plurality of parallel-form image signals.

* * * * *